US011834383B2

(12) United States Patent
Reaves et al.

(10) Patent No.: US 11,834,383 B2
(45) Date of Patent: Dec. 5, 2023

(54) ENERGETIC FEEDSTOCK FOR ADDITIVE MANUFACTURING

(71) Applicant: Lynntech, Inc., College Station, TX (US)

(72) Inventors: Kelley Reaves, College Station, TX (US); Jared Mike, College Station, TX (US); Richard Sanchez, Jr., Bryan, TX (US); Billy McCulloch, Bryan, TX (US); Anthony Giletto, College Station, TX (US); David M. Battaglia, College Station, TX (US); Kacey G. Ortiz, Auburn, AL (US)

(73) Assignee: Lynntech, Inc., College Station, TX (US)

( * ) Notice: Subject to any disclaimer, the term of this patent is extended or adjusted under 35 U.S.C. 154(b) by 966 days.

(21) Appl. No.: 16/698,562

(22) Filed: Nov. 27, 2019

(65) Prior Publication Data

US 2021/0276931 A1 Sep. 9, 2021

Related U.S. Application Data

(60) Provisional application No. 62/771,962, filed on Nov. 27, 2018.

(51) Int. Cl.
*C06B 45/10* (2006.01)
*C06B 25/10* (2006.01)
(Continued)

(52) U.S. Cl.
CPC ..... *C06B 45/10* (2013.01); *C06B 21/0025* (2013.01); *C06B 21/0033* (2013.01);
(Continued)

(58) Field of Classification Search
CPC . C06B 45/10; C06B 21/0025; C06B 21/0033; C06B 25/00; C06B 25/10;
(Continued)

(56) References Cited

U.S. PATENT DOCUMENTS 5,031,539 A * 7/1991 Hutchens ..... F02K 9/346 264/3.1
10,766,832 B1 * 9/2020 Laktas ..... C01B 3/0078
(Continued)

FOREIGN PATENT DOCUMENTS

WO 2017006109 A1 1/2017
WO 2017006110 A1 1/2017

*Primary Examiner* — James E McDonough
(74) *Attorney, Agent, or Firm* — Edwin S. Flores; Daniel J. Chalker; Chalker Flores, LLP

(57) ABSTRACT

The present invention comprises formulations and method for additive manufacturing comprising: a pot-stable photo-curable polymer; one or more fillers; and one or more additives, wherein the formulation cures into a polymer in six hours or less upon exposure to light. In certain examples, the additive manufacturing is a moldless method of additive manufacturing by preparing a formulation comprising: a pot-stable photo-curable polymer, one or more fillers, and one or more additives, and exposing the formulation to light in an amount that substantially cures the polymer in 6 hours or less.

20 Claims, 15 Drawing Sheets

(51) Int. Cl.

| | |
|---|---|
| ***C06B 25/34*** | (2006.01) |
| ***C06B 29/22*** | (2006.01) |
| ***C06B 31/28*** | (2006.01) |
| ***C06B 21/00*** | (2006.01) |
| ***C06B 25/00*** | (2006.01) |

(52) U.S. Cl.
CPC ..... *C06B 25/00* (2013.01); *C06B 25/10* (2013.01); *C06B 25/34* (2013.01); *C06B 29/22* (2013.01); *C06B 31/28* (2013.01); *C06B 45/105* (2013.01)

(58) Field of Classification Search
CPC ..... C06B 25/34; C06B 29/22; C06B 31/28; C06B 45/105
USPC ..... 149/14
See application file for complete search history.

(56) References Cited

U.S. PATENT DOCUMENTS

2004/0065075 A1* 4/2004 Peterson ..... F02K 9/08 60/253
2013/0042596 A1 2/2013 Fuller

* cited by examiner

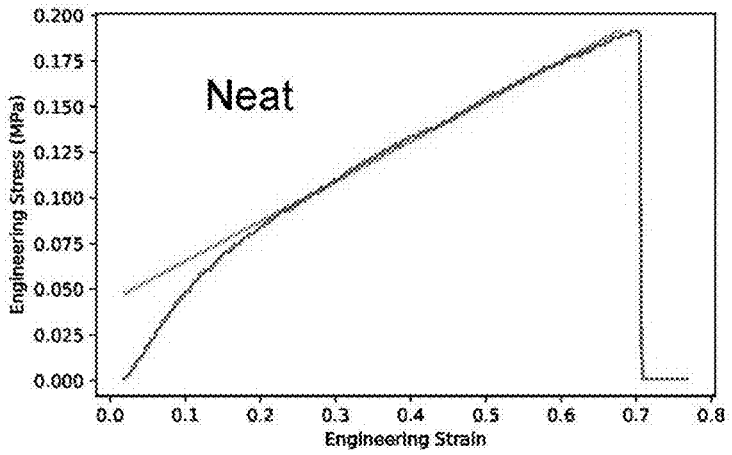
FIG. 10
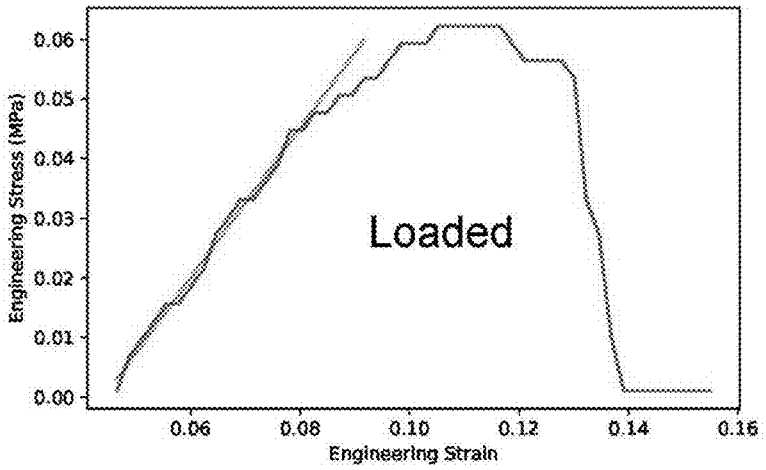
FIG. 11
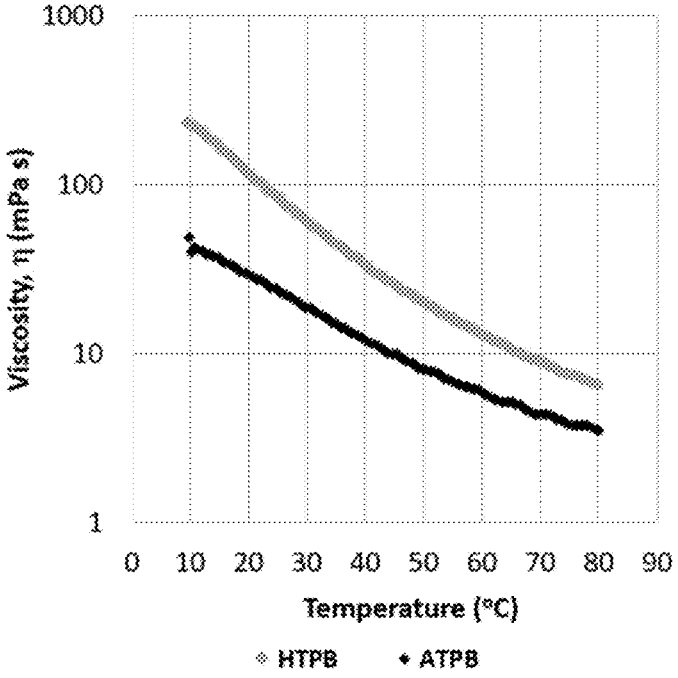

ENERGETIC FEEDSTOCK FOR ADDITIVE MANUFACTURING

CROSS-REFERENCE TO RELATED APPLICATIONS

This application claims priority to U.S. Provisional Application Ser. No. 62/771,962, filed Nov. 27, 2018, the entire contents of which are incorporated herein by reference.

STATEMENT OF FEDERALLY FUNDED RESEARCH

This invention was made with government support under N00178-17-C-1129 awarded by the U.S. Department of the Navy. The government has certain rights in the invention.

TECHNICAL FIELD OF THE INVENTION

The present invention relates in general to the field of energetic feedstocks for additive manufacturing.

BACKGROUND OF THE INVENTION

Without limiting the scope of the invention, its background is described in connection with testing of materials made using standard curing processes.

Polymer-Bonded Explosives. A polymer-bonded explosive, also called PBX or plastic-bonded explosive, is an explosive material in which explosive powder is bound together in a matrix using small quantities of a synthetic polymer (binder). A significant portion of PBX are cast-cured PBX. These PBX are generally prepared in a multi-step process that usually includes three mains steps: 1) mixing the components of the formulation or composition, 2) forming the shape, and 3) curing.

The components of the PBX formulation typically contain the filler (e.g. the energetic), polymer binder, and crosslinking agent(s). The mixture is then shaped by one of a variety of methods including casting, pressing, extruding, or molding. Once formed, the shape is cured during which the polymer binder forms chemical crosslinks to further solidify and stabilize the shape. The curing process can start as soon as the components are mixed together or initiated (and/or accelerated) through the application of external heat. Once cured, the polymeric binder is a tough elastomeric rubber capable of absorbing and dissipating energy from hazardous stimuli making it useful for Insensitive Munitions (IM) applications.

In addition to explosives, the materials and methods of PBX formulations are also applied to composite propellants. An example is the preparation of an ammonium perchlorate (AP)/HTPB (Hydroxyl-terminated polybutadiene) composite used as a solid propellant in rocket propulsion applications. In this example, AP (≤88 wt %) is the energetic, HTPB is the polymer binder (≤12 wt %) and a diisocyanate is the crosslinking agent (≤1 wt %). AP-based composite propellants have been a workhorse in the field of solid rocket propulsion for more than five decades. This type of propellant typically contains a multi-modal distribution of AP ($NH_4ClO_4$) grains (about 20 to 200 mm) embedded in the HTPB matrix. HTPB is the most commonly used binder because it achieves high combustion performance and the desired physical and mechanical properties of the final cured shape. The diisocyanate is a crosslinking agent that reacts with the hydroxyl groups in the HTPB to form inter chain carbamate (urethane) links. The selection of the diisocyanate (i.e. toluene diisocyanate, TDI, isophorone diisocyanate, IPDI, 4,4'-diphenylmethane diisocyanate, MDI) will influence the rate of crosslinking and the final physical and mechanical properties of the solid shape.

However, this approach has numerous drawbacks and is illustrated in FIG. 1. The graph plots PBX extent of curing (i.e. Shore A Hardness) as a function of Time and shows the two main problems with the conventional approach. The first problem is that polymerization of the binder and crosslinking agents generally starts immediately upon mixing of the components (also described as "curing in the pot"). Consequently, some material is pre-polymerized at the time the shape is formed introducing non-homogeneous crosslinking, bubbles, and clumps in the final shape. This is especially problematic when multiple, sequential casts are prepared from the same pot. The casts poured last have more pre-polymerized material than those poured first. In addition, the "pot" can solidify before all molds have been filled which wastes material and generates a hazardous waste.

The second problem is that curing can take up to a week at elevated temperature. This extensive curing time is especially problematic when new formulations are being developed through an iterative process. It simply takes too long to mix, pour, cast, cure, and test.

International Patent Application Number WO 2017/006109A1, filed by Stevens, et al., describes a cast explosive composition in which the stability of the composition is improved. The Application achieves this through the chemical protection of the crosslinking agent with a thermally labile protecting group. Consequently, the composition is stable in the pot. The composition can be cast and crosslinking of the polymer binder starts when the cast material is heated to the requisite temperature to trigger the chemical deprotection of the crosslinking agent. The Application also states that the protecting group can be removed by other stimuli including pressure, ultrasound, EM radiation, catalyst, or a shear force. However, the invention in this application suffers a very common problem associated with thermally cured PBX compositions—curing can take days to weeks to be complete. This reality is especially problematic because the curing time is too long to allow the rapid development and testing of new PBX formulations, mixtures, and shapes.

International Patent Application Number WO 2017/006110A1, filed by Stevens, et al., describes a pre-cast explosive material composition that includes an explosive material, a polymerizable binder, and a microencapsulated cross linker.

U.S. Patent Publication No. 20040065075, filed by Peterson, et al., is directed to an ultraviolet light curable rocket motor liner. Briefly, these applicants are said to teach an ultraviolet curable bond liner with a high filler content that is curable sufficiently for casting of the propellant by exposure to ultraviolet light at a wavelength between 350 and 400 nm. By irradiating the liner at this wavelength, the initiator can be activated without interference from the filler components or heat cured liner components. After the casting of the propellant, the bond liner is heat cured along with the propellant.

U.S. Patent Publication No. 20130042596, filed by Fuller, is directed to Systems and Methods for Fabricating Hybrid Rocket Fuel Motor Fuel Grains. Briefly, this applicant is said to teach systems and methods for fabricating hybrid rocket motor fuel grains that include: a method for fabricating a rocket motor fuel grain; a platform operable to support a rocket motor fuel grain during fabrication; and disposing at least one fuel material onto the platform to form a material layer. Further, the method is said to include successively disposing additional fuel material onto the material layer in small amounts, wherein the rocket motor fuel grain is formed on the platform.

Finally, U.S. Pat. No. 5,031,539, filed by Hutchens is directed to a radiation curable rocket motor liner for case bonded solid propellant. Briefly, this inventors is said to teach an improved bonding of hydroxyl-terminated polybutadiene based propellant grains to rocket motor liners and liners which are ultraviolet light radiation curable by employing an acrylated polymer and an [[[(isocyanatoorgano)amino]carbonyl]oxy] alkyl propanoate in the liner composition.

Thus, a need remains for novel methods and formulations that allow for faster cure times, ease of manufacturing, and an improved ability to test materials in various shapes.

SUMMARY OF THE INVENTION

In one embodiment, the present invention comprises a formulation for additive manufacturing comprising: a pot-stable photo-curable polymer; one or more fillers; and one or more additives, wherein the formulation cures into a polymer in six hours or less upon exposure to light. In one aspect, the one or more fillers is selected from at least one of: nitrotriazolone (NTO); 1,3,5-trinitro-1,3,5-triazinane (RDX); 1,3,5,7-tetranitro-1,3,5,7-tetrazocane (HMX); hexanitrohexaazaisowurtzitane (HNIW/CL-20); ethylene dinitramine (EDNA); aromatic nitramines such as trinitrophenylmethylnitramine (tetryl); nitroglycerine (NG); butanetriol trinitrate (BTTN); pentaerythritol tetranitrate (PETN); 2,4-dinitroanisole (DNAN); trinitrotoluene (TNT); hexanitrostilbene (HNS); triaminotrinitrobenzene (TATB); 1,1-diamino-2,2-dinitroethene (DADNE/FOX-7); inorganic oxidizers such as ammonium nitrate (AN); ammonium perchlorate (AP); ammonium dinitramide (ADN); guanylurea dinitramide (GUDN/FOX-12); energetic alkali metal salts; energetic alkaline earth metal salts; and combinations thereof. In another aspect, the polymer has a backbone (linear or branched) that is selected from at least one of: polybutadiene, poly(butadiene-co-acrylonitrile), poly(azidomethyl ethylene oxide), poly(bis-azidomethyl oxetane), poly(nitratomethyl-methyl oxetane), poly(azidomethyl-methyl oxetane), poly(bis-nitratomethyl oxetane), poly(methylmethacrylate), polyacrylic acid, polystyrene, polytetrafluoroethylene, perfluoropolyether, poly(ethylene glycol), polycarbonate, polyethylene terephthalate, polyurethanes, vinyl polydimethylsiloxane, thiol polydimethylsiloxane, polystyrene butadiene, polyvinylidene fluoride, Nylon, poly (paraphenylene terephthalamide), and poly(metaphenylene terephthalamide). In another aspect, the polymer has two or more terminal groups of the polymer can either directly participate in polymerization or can be photolabile protecting groups that when cleaved with light, expose a new polymer terminus that then participates in polymerization, selected from at least one of: acrylate, methacrylate, allyl, allyl ether, vinyl, vinyl ether, styryl, vinyl arene, thiol, thioketone, and thioester and the photolabile protecting groups comprise: 2-nitrobenzyl bromide; 2,4-dinitrobenzyl; 4,5-dimethoxy-2-nitrobenzyl; 4-nitro-5-methoxybenzyl; and 2-nitrobenzyl In another aspect, a polymer side chain of the one or more polymers is selected from at least one of: polyethylene glycol and polyvinyl alcohol. In another aspect, a polymer side chain modifier of the one or more polymers is selected from at least one of: azide and furoxane. In another aspect, the one or more fillers is present in the range of about 2-20%, often about 5-15%, or about 8-12% weight-to-weight. In another aspect, the one or more fillers comprise one or more of the following components: (1) a metal powder; (2) a ceramic; or a conductive material. In another aspect, the metal powder is selected from at least one of: aluminum, magnesium, tungsten, nickel, alloys of these metals, and combinations thereof. In another aspect, the ceramic is selected from at least one of: nanostructured zirconia powder, nanostructured silicon carbide or nitride, $B_6O$, and combinations thereof. In another aspect, the conductive material is selected from at least one of: fullerene $C_{60}$, fullerene $C_{70}$, graphene, single-wall carbon nanotubes, multiwall carbon nanotubes, graphene oxide, reduced graphene oxide, carboxylic acid-functionalized carbon nanotubes, $MoS_2$ nanosheets, 2-dimensional $Ti_3C_2$, 2-dimensional $TiC_2$, 2-dimensional $Mo_3C_2$, 2-dimensional $MoC_2$, 2-dimensional $Ti_3C_2$, 2-dimensional $TiC_2$, 2-dimensional $V_3C_2$, 2-dimensional $VC_2$, 2-dimensional $Cr_3C_2$, 2-dimensional $CrC_2$, 2-dimensional $Nb_3C_2$, 2-dimensional $NbC_2$. In another aspect, the one or more fillers is present in the composition in a range of about 80-98%, often about 85-95%, or about 88-92% weight to weight. In another aspect, the formulation further comprises one or more additives selected from at least one of: (1) one or more crosslinkers; (2) one or more chain transfer reagents; (3) one or more burn-rate modifiers; (4) one or more stabilizers; (5) one or more photoinitiators; or (6) one or more plasticizers. In another aspect, the one or more crosslinkers is selected from at least one of: 1,3-benzenedithiol; 1,2-ethanedithiol; 1,3-propanedithiol; 1,4-butanedithiol; 1,5-pentanedithiol; dithiothreitol; 1,4-benzenedithiol; 1,3-divinylbenzene; 1,4-divinylbenzene; 1,2-divinylbenzene; 1,3,5-trivinylbenzene; and 2,6-dithionaphthalene; diphenylmethane 4,4'-diisocyanate; toluene 2,4-diisocyanate; isophorone diisocyanate; hexamethylene diisocyanate; 1,4-phenylene diisocyanate; 1,3-phenylene diisocyanate; m-xylylene diisocyanate; tolylene-2,6-diisocyanate. In another aspect, the one or more chain transfer reagents is selected from at least one of: methyl benzyl trithiocarbonate; dibenzyl trithiocarbonate; dimethyl trithiocarbonate; bis(carboxymethyl)trithiocarbonate; 2-(dodecylthiocarbonothioylthio)-2-methylpropionic acid; 2-(dodecylthiocarbonothioylthio) propionic acid; 2-cyano-2-propyl dodecyl trithiocarbonate; cyanomethyl dodecyl trithiocarbonate; 4-cyano-4-[(dodecyl sulfanylthiocarbonyl)sulfanyl]pentanoic acid; 4-cyano-4-[(dodecyl sulfanylthiocarbonyl)sulfanyl] pentanol; 2-(2-carboxyethylsulfanylthiocarbonylsulfanyl) propionic acid; Methyl 2-(dodecylthiocarbonothioylthio)-2-methylpropionate; pentaerythritol tetrakis[2-(dodecylthiocarbonothioylthio)-2-methylpropionate]; 3,5-bis(2-dodecylthiocarbonothioylthio-1-oxopropoxy) benzoic acid; 1,1,1-tris [(dodecylthiocarbonothioylthio)-2-methylpropionate] ethane; 4-((((2-carboxyethyl)thio)carbonothioyl)thio)-4-cyanopentanoic acid; benzyl benzodithioate; 2-cyano-2-propyl benzodithioate; 4-cyano-4-(phenylcarbonothioylthio) pentanoic acid; cyanomethyl benzodithioate; 2-cyano-2-propyl 4-cyanobenzodithioate; ethyl 2-(4-methoxyphenylcarbonothioylthio)acetate; ethyl 2-methyl-2-(phenylthiocarbonylthio)propionate; ethyl 2-(phenylcarbonothioylthio)-2-phenylacetate; ethyl 2-(phenylcarbonothioylthio)propionate; 1-(methoxycarbonyl)ethyl benzodithioate; 2-(4-methoxyphenylcarbonothioylthio)ethanoic acid; 2-(phenylcarbonothioylthio)propanoic acid; 2-phenyl-2-propyl benzodithioate; cyanomethyl methyl(phenyl)carbamodithioate; benzyl 1H-pyrrole-1-carbodithioate; cyanomethyl diphenylcarbamodithioate; cyanomethyl methyl (4-pyridyl)carbamodithioate; 2-cyanopropan-2-yl N-methyl-N-(pyridin-4-yl)carbamodithioate; or methyl 2-[methyl(4-pyridinyl)carbamothioylthio]propionate. In another aspect, the one or more burn-rate modifiers is selected from at least one of: iron(II) oxide; iron(III) oxide; iron(III) hydroxide; iron(II,III) oxide; ferrocene; copper(I) oxide; copper(II) oxide; copper chromite; copper salicylate; copper stearate; hexamminecopper(II) perchlorate; cerium (IV) ammonium nitrate; cerium(IV) oxide; hexamminecobalt(II) perchlorate; cobaltocene; hexamminezinc(II) perchlorate; bismuth salicylate; or bismuth subsalicylate. In another aspect, the one or more stabilizers is selected from at least one of: N,N'-bis(cyclohexyl)urea; N,N'-diphenylurea; di-tert-butyl resorcinol (DBR); N-ethyl-para-toluenesulfonamide (NETS); diphenylamine (DPA); alkylated DPA (Agerite Stalite); isopropoxy DPA (ISO); dinapthyl phenylenediamine (Agerite White); napthyl phenylamine (Neozone-D); 2-nitrodiphenyl amine (NDPA); 2,4-dinitrophenylamine (DNDPA); N,N'-diphenyl para-phenylenediamine; dinapthyl phenylenediamine; methylaminoanthraquinone; N,N'-diphenylbenzidine; tetraphenylhydrazine; para-nitroaniline; N-methyl-ortho-nitroaniline; N-methyl-para-nitroaniline (NMA); N-ethyl-para-nitroaniline (NENA); N-(2-cyanoethyl)-para-chloroaniline; N-phenacyl-para-chloroaniline; di(tridecyl)thiodipropionate; elemental sulfur; or 2,2'-methylenebis-(4-methyl-6-tert-butylphenol) (AO-2246). In another aspect, the light is a photoinitiator selected from at least one of: Type I photoinitiators, or Type II photoinitiators and co-initiators. In another aspect, the formulation further comprises one or more plasticizers is selected from at least one of: both energetic and inert plasticizers and selected from at least one of: dioctyl adipate (DOA); isodecyl pelargonate (IDP); N-butylnitratoethylnitramine (butylNENA); nitroglycerine; butanetriol trinitrate (BTTN); dinitrotoluene (DNT); trimethylolethane trinitrate (TMETN); diethylene glycol dinitrate (DEGDN); triethylene glycol dinitrate (TEGDN); bis(2,2-dinitropropyl) formal (BDNPF); bis(2,2-dinitropropyl)acetal (BDNPA); and 2,2,2-trinitroethyl 2-nitroxyethyl ether (TNEN); TA (Triacetin); DEP (diethylphathalate); and DBP (dibutylphathalate); trimethylol ethane trinitrate; triethylene glycol dinitrate; ethylene glycol dinitrate; 1,2,4-butanetriol trinitrate; nitroglycerine; bis(2,2,-dinitropropyl)acetal; bis(2,2,-dinitropropyl) formal; glycidyl azide; ethylene glycol bis(azidoacetate); diethylene glycol bis(azidoacetate); trimethylol nitromethane tris(azidoacetate); pentaerythritol tetrakis(azidoacetate); 2,4-dinitroethylbenzene; 2,4,6-trinitroethylbenzene; methyl nitratoethylnitramine; ethyl nitratoethylnitramine; propyl nitratoethylnitramine; butyl nitratoethylnitramine; pentyl nitratoethylnitramine; isopropyl nitratoethylnitramine; 1,5-diazido-3-nitrazapentane; dinitroxy ethyl nitramine; dioctyl phthalate; diisononyl phthalate; dioctyl adipate; diisononyl adipate; bis(2-ethylhexyl) phthalate; diisodecyl phthalate; bis(2-ethylhexyl) adipate; bis(2-ethylhexyl) terephthalate; dioctyl terephthalate; and 2-nitrophenyl octyl ether. In another aspect, the one or more additives are present in the composition in amounts less than 5%, often less than 2%, or around 1% weight-to-weight. In another aspect, a chemical protecting group is added to prevent curing in the presence of one or more isocyanates.

In another embodiment, the present invention comprises a method of additive manufacturing of a formulation comprising: preparing a formulation comprising: a pot-stable photo-curable polymer; one or more fillers; and one or more additives; exposing the formulation to a photoinitiator, wherein the formulation substantially cures the polymer in 6 hours or less. In one aspect, the one or more fillers is selected from at least one of: nitrotriazolone (NTO); 1,3,5-trinitro-1,3,5-triazinane (RDX); 1,3,5,7-tetranitro-1,3,5,7-tetrazocane (HMX); hexanitrohexaazaisowurtzitane (HNIW/CL-20); ethylene dinitramine (EDNA); aromatic nitramines such as trinitrophenylmethylnitramine (tetryl); nitroglycerine (NG); butanetriol trinitrate (BTTN); pentaerythritol tetranitrate (PETN); 2,4-dinitroanisole (DNAN); trinitrotoluene (TNT); hexanitrostilbene (HNS); triaminotrinitrobenzene (TATB); 1,1-diamino-2,2-dinitroethene (DADNE/FOX-7); inorganic oxidizers such as ammonium nitrate (AN); ammonium perchlorate (AP); ammonium dinitramide (ADN); guanylurea dinitramide (GUDN/FOX-12); energetic alkali metal salts; energetic alkaline earth metal salts; and combinations thereof. In another aspect, the polymer has a backbone (linear or branched) that is selected from at least one of: polybutadiene, poly(butadiene-co-acrylonitrile), poly(azidomethyl ethylene oxide), poly(bis-azidomethyl oxetane), poly(nitratomethyl-methyl oxetane), poly(azidomethyl-methyl oxetane), poly(bis-nitratomethyl oxetane), poly(methylmethacrylate), polyacrylic acid, polystyrene, polytetrafluoroethylene, perfluoropolyether, poly(ethylene glycol), polycarbonate, polyethylene terephthalate, polyurethanes, vinyl polydimethyl siloxane, thiol polydimethylsiloxane, polystyrene butadiene, polyvinylidene fluoride, Nylon, poly(paraphenylene terephthalamide), and poly(metaphenylene terephthalamide). In another aspect, the p polymer has two or more terminal groups of the polymer can either directly participate in polymerization or can be photolabile protecting groups that when cleaved with light, expose a new polymer terminus that then participates in polymerization, selected from at least one of: acrylate, methacrylate, allyl, allyl ether, vinyl, vinyl ether, styryl, vinyl arene, thiol, thioketone, and thioester and the photolabile protecting groups comprise: 2-nitrobenzyl bromide; 2,4-dinitrobenzyl; 4,5-dimethoxy-2-nitrobenzyl; 4-nitro-5-methoxybenzyl; and 2-nitrobenzyl. In another aspect, a polymer side chain of the polymer is selected from at least one of: polyethylene glycol and polyvinyl alcohol. In another aspect, a polymer side chain modifier of the polymer is selected from at least one of: azide and furoxane. In another aspect, the one or more fillers is present in the range of about 2-20%, often about 5-15%, or about 8-12% weight-to-weight. In another aspect, the one or more fillers comprises of one or more of the following components: (1) a metal powder; (2) a ceramic; or a conductive material. In another aspect, the metal powder is selected from at least one of: aluminum, magnesium, tungsten, nickel, alloys of these metals, and combinations thereof. In another aspect, the ceramic is selected from at least one of: nanostructured zirconia powder, nanostructured silicon carbide or nitride, $B_6O$, and combinations thereof. In another aspect, the conductive material is selected from at least one of: fullerene $C_{60}$, fullerene $C_{70}$, graphene, single-wall carbon nanotubes, multiwall carbon nanotubes, graphene oxide, reduced graphene oxide, carboxylic acid-functionalized carbon nanotubes, $MoS_2$ nanosheets, 2-dimensional $Ti_3C_2$, 2-dimensional $TiC_2$, 2-dimensional $Mo_3C_2$, 2-dimensional $MoC_2$, 2-dimensional $Ti_3C_2$, 2-dimensional $TiC_2$, 2-dimensional $V_3C_2$, 2-dimensional $VC_2$, 2-dimensional $Cr_3C_2$, 2-dimensional $CrC_2$, 2-dimensional $Nb_3C_2$, 2-dimensional $NbC_2$. In another aspect, the one or more fillers is present in the composition in a range of about 80-98%, often about 85-95%, or about 88-92% weight to weight. In another aspect, the method further comprises adding one or more additives selected from at least one of: (1) one or more crosslinkers; (2) one or more chain transfer reagents; (3) one or more burn-rate modifiers; (4) one or more stabilizers; (5) one or more photoinitiators; or (6) one or more plasticizers. In another aspect, the one or more crosslinkers is selected from at least one of: 1,3-benzenedithiol; 1,2-ethanedithiol; 1,3-propanedithiol; 1,4-butanedithiol; 1,5-pentanedithiol; dithiothreitol; 1,4-benzenedithiol; 1,3-divinylbenzene; 1,4-divinylbenzene; 1,2-divinylbenzene; 1,3,5-trivinylbenzene; and 2,6-dithionaphthalene; diphenylmethane 4,4'-diisocyanate; toluene 2,4-diisocyanate; isophorone diisocyanate; hexamethylene diisocyanate; 1,4-phenylene diisocyanate; 1,3-phenylene diisocyanate; m-xylylene diisocyanate; tolylene-2,6-diisocyanate. In another aspect, the one or more chain transfer reagents is selected from at least one of: methyl benzyl trithiocarbonate; dibenzyl trithiocarbonate; dimethyl trithiocarbonate; bis(carboxymethyl)trithiocarbonate; 2-(dodecylthiocarbonothioylthio)-2-methylpropionic acid; 2-(dodecylthiocarbonothioylthio) propionic acid; 2-cyano-2-propyl dodecyl trithiocarbonate; cyanomethyl dodecyl trithiocarbonate; 4-cyano-4-[(dodecylsulfanylthiocarbonyl)sulfanyl]pentanoic acid; 4-cyano-4-[(dodecylsulfanylthiocarbonyl)sulfanyl] pentanol; 2-(2-carboxyethylsulfanylthiocarbonylsulfanyl) propionic acid; Methyl 2-(dodecylthiocarbonothioylthio)-2-methylpropionate; pentaerythritol tetrakis [2-(dodecylthiocarbonothioylthio)-2-methylpropionate]; 3,5-bis(2-dodecylthiocarbonothioylthio-1-oxopropoxy) benzoic acid; 1,1,1-tris[(dodecylthiocarbonothioylthio)-2-methylpropionate]ethane; 4-((((2-carboxyethyl)thio)carbonothioyl)thio)-4-cyanopentanoic acid; benzyl benzodithioate; 2-cyano-2-propyl benzodithioate; 4-cyano-4-(phenylcarbonothioylthio)pentanoic acid; cyanomethyl benzodithioate; 2-cyano-2-propyl 4-cyanobenzodithioate; ethyl 2-(4-methoxyphenylcarbonothioylthio)acetate; ethyl 2-methyl-2-(phenylthiocarbonylthio)propionate; ethyl 2-(phenylcarbonothioylthio)-2-phenylacetate; ethyl 2-(phenylcarbonothioylthio)propionate; 1-(methoxycarbonyl)ethyl benzodithioate; 2-(4-methoxyphenylcarbonothioylthio) ethanoic acid; 2-(phenylcarbonothioylthio)propanoic acid; 2-phenyl-2-propyl benzodithioate; cyanomethyl methyl (phenyl)carbamodithioate; benzyl 1H-pyrrole-1-carbodithioate; cyanomethyl diphenylcarbamodithioate; cyanomethyl methyl(4-pyridyl)carbamodithioate; 2-cyanopropan-2-yl N-methyl-N-(pyridin-4-yl)carbamodithioate; or methyl 2-[methyl(4-pyridinyl)carbamothioylthio]propionate. In another aspect, the one or more burn-rate modifiers is selected from at least one of: iron(II) oxide; iron(III) oxide; iron(III) hydroxide; iron(II,III) oxide; ferrocene; copper(I) oxide; copper(II) oxide; copper chromite; copper salicylate; copper stearate; hexamminecopper(II) perchlorate; cerium (IV) ammonium nitrate; cerium(IV) oxide; hexamminecobalt(II) perchlorate; cobaltocene; hexamminezinc(II) perchlorate; bismuth salicylate; or bismuth subsalicylate. In another aspect, the one or more stabilizers is selected from at least one of: N,N'-bis(cyclohexyl)urea; N,N'-diphenylurea; di-tert-butyl resorcinol (DBR); N-ethyl-para-toluenesulfonamide (NETS); diphenylamine (DPA); alkylated DPA (Agerite Stalite); isopropoxy DPA (ISO); dinapthyl phenylenediamine (Agerite White); napthyl phenylamine (Neozone-D); 2-nitrodiphenyl amine (NDPA); 2,4-dinitrophenylamine (DNDPA); N,N'-diphenyl para-phenylenediamine; dinapthyl phenylenediamine; methylaminoanthraquinone; N,N'-diphenylbenzidine; tetraphenylhydrazine; para-nitroaniline; N-methyl-ortho-nitroaniline; N-methyl-para-nitroaniline (NMA); N-ethyl-para-nitroaniline (NENA); N-(2-cyanoethyl)-para-chloroaniline; N-phenacyl-para-chloroaniline; di(tridecyl)thiodipropionate; elemental sulfur; or 2,2'-methylenebis-(4-methyl-6-tert-butylphenol) (AO-2246). In another aspect, the one or more photoinitiator is selected from at least one of: Type I photoinitiators, or Type II photoinitiators and co-initiators. In another aspect, the method further comprises adding one or more plasticizers is selected from at least one of: both energetic and inert plasticizers and selected from at least one of: dioctyl adipate (DOA); isodecyl pelargonate (IDP); N-butylnitratoethylnitramine (butylNENA); nitroglycerine; butanetriol trinitrate (BTTN); dinitrotoluene (DNT); trimethylolethane trinitrate (TMETN); diethylene glycol dinitrate (DEGDN); triethylene glycol dinitrate (TEGDN); bis(2,2-dinitropropyl) formal (BDNPF); bis(2,2-dinitropropyl)acetal (BDNPA); and 2,2,2-trinitroethyl 2-nitroxyethyl ether (TNEN); TA (Triacetin); DEP (diethylphathalate); and DBP (dibutylphathalate); trimethylol ethane trinitrate; triethylene glycol dinitrate; ethylene glycol dinitrate; 1,2,4-butanetriol trinitrate; nitroglycerine; bis(2,2,-dinitropropyl)acetal; bis(2,2,-dinitropropyl) formal; glycidyl azide; ethylene glycol bis(azidoacetate); diethylene glycol bis(azidoacetate); trimethylol nitromethane tris(azidoacetate); pentaerythritol tetrakis(azidoacetate); 2,4-dinitroethylbenzene; 2,4,6-trinitroethylbenzene; methyl nitratoethylnitramine; ethyl nitratoethylnitramine; propyl nitratoethylnitramine; butyl nitratoethylnitramine; pentyl nitratoethylnitramine; isopropyl nitratoethylnitramine; 1,5-diazido-3-nitrazapentane; dinitroxy ethyl nitramine; dioctyl phthalate; diisononyl phthalate; dioctyl adipate; diisononyl adipate; bis(2-ethylhexyl) phthalate; diisodecyl phthalate; bis(2-ethylhexyl) adipate; bis(2-ethylhexyl) terephthalate; dioctyl terephthalate; and 2-nitrophenyl octyl ether. In another aspect, the one or more additives are present in the composition in amounts less than 5%, often less than 2%, or around 1% weight-to-weight. In another aspect, a chemical protecting group is added to the polymer prevent curing in the presence of one or more isocyanates. In another aspect, the formulation is stored in a container that is light-impervious. In another aspect, the one or more components of the formulation are stored in a light-impervious container. In another aspect, the formulation is exposed to light concurrently with the printing process.

In another embodiment, the present invention comprises an additive materials system comprising: a stage; and a printer in fluid communication with at least one source of a formulation stored in a container that is light-impervious comprising: a pot-stable photo-curable polymer; one or more fillers; and one or more additives; and a source of light for exposing the formulation, wherein the light is provided in an amount sufficient to substantially cure the formulation in 6 hours or less.

In another embodiment, the present invention comprises a photocurable polymer-bonded explosive made by a method comprising: preparing a formulation comprising: a pot-stable photo-curable polymer; one or more fillers; and one or more additives; and printing the formulation additively on a surface; and exposing the formulation to light in an amount that substantially cures the polymer in 6 hours or less.

In another embodiment, the present invention comprises a moldless method of additive manufacturing of a polymer-bonded explosive comprising: preparing a formulation comprising: a pot-stable photo-curable polymer; one or more fillers; and one or more additives; and exposing the formulation to light in an amount that substantially cures the polymer in 6 hours or less. In one aspect, the one or more components of the formulation are stored in a light-impervious container. In another aspect, the formulation is exposed to light concurrently with the printing process.

In another embodiment, the present invention comprises a formulation for additive manufacturing comprising: a mixture of a pot-stable photo-curable polymer and a thermally curable polymer; one or more fillers; and one or more additives, wherein the formulation cures into a fully cured polymer in six hours or less upon exposure to light and heat. In one aspect, the one or more fillers are selected from at least one of: nitrotriazolone (NTO); 1,3,5-trinitro-1,3,5-triazinane (RDX); 1,3,5,7-tetranitro-1,3,5,7-tetrazocane (HMX); hexanitrohexaazaisowurtzitane (HNIW/CL-20); ethylene dinitramine (EDNA); aromatic nitramines such as trinitrophenylmethylnitramine (tetryl); nitroglycerine (NG); butanetriol trinitrate (BTTN); pentaerythritol tetranitrate (PETN); 2,4-dinitroanisole (DNAN); trinitrotoluene (TNT); hexanitrostilbene (HNS); triaminotrinitrobenzene (TATB); 1,1-diamino-2,2-dinitroethene (DADNE/FOX-7); inorganic oxidizers such as ammonium nitrate (AN); ammonium perchlorate (AP); ammonium dinitramide (ADN); guanylurea dinitramide (GUDN/FOX-12); energetic alkali metal salts; energetic alkaline earth metal salts; or combinations thereof. In another aspect, the polymer has a backbone (linear or branched) that is selected from at least one of: polybutadiene, glycidyl azide polymers (GAP), Dicyclopentadiene (DCPD), poly(butadiene-co-acrylonitrile), poly(azidomethyl ethylene oxide), poly(bis-azidomethyl oxetane), poly (nitratomethyl-methyl oxetane), poly(azidomethyl-methyl oxetane), poly(bis-nitratomethyl oxetane), poly(methylmethacrylate), polyacrylic acid, polystyrene, polytetrafluoroethylene, perfluoropolyether, poly(ethylene glycol), polycarbonate, polyethylene terephthalate, polyurethanes, vinyl polydimethylsiloxane, thiol polydimethylsiloxane, polystyrene butadiene, polyvinylidene fluoride, Nylon, poly(paraphenylene terephthalamide), or poly(metaphenylene terephthalamide). In another aspect, the polymer has two or more terminal groups of the polymer can either directly participate in polymerization or can be photolabile protecting groups that when cleaved with light, expose a new polymer terminus that then participates in polymerization, selected from at least one of: acrylate, methacrylate, allyl, allyl ether, vinyl, vinyl ether, styryl, vinyl arene, thiol, thioketone, and thioester and the photolabile protecting groups comprise: 2-nitrobenzyl bromide; 2,4-dinitrobenzyl; 4,5-dimethoxy-2-nitrobenzyl; 4-nitro-5-methoxybenzyl; or 2-nitrobenzyl. In another aspect, the polymer has two or more terminal groups of the polymer that can either directly participate in polymerization and/or can be thermally accelerated to do so, and wherein such groups comprise: hydroxyl, carboxyl, amine, thiol, ester, or ether. In another aspect, thermal polymerization (thermosetting) is achieved utilizing at least one of the following polymerization processes: ring-opening metathesis polymerization (ROMP), reversible addition-fragmentation chain-transfer polymerization (RAFT), diisocyanate crosslinking, thermosetting epoxy resins, sulfur vulcanization, thermally activated peroxide crosslinking.

BRIEF DESCRIPTION OF THE DRAWINGS

For a more complete understanding of the features and advantages of the present invention, reference is now made to the detailed description of the invention along with the accompanying figures and in which:

FIG. 10 includes two plots that show the stress strain curves for chemistry 1 with and without sieved/fractionated >200 μm NaCl crystal filler loaded at 80% by mass.

FIG. 11 is a plot that shows the photocurable ATPB (Form. #1, black) is always thinner than the conventional HTPB formulation (grey) over a wide temperature range. This characteristic is desirable for both the additive manufacturing of PBX and for the more conventional methods of casting, pressing, extruding, or molding.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not limit the invention, except as outlined in the claims.

Additive Manufacturing. Additive manufacturing or 3D printing is a process of joining materials layer upon layer from 3D model data. It starts with the design of the object using 3D modeling software or a scan of the object. Dedicated software then slices that model into cross-sectional layers, creating a new file, and sends it to the 3D-printing machine. The 3D-printing machine subsequently creates the object by selectively placing each layer of material.

3D-printing technologies differ by the way they create each layer. Some use thermal energy from laser or electron beam to melt or sinter metal or polymer powder together (e.g. Laser Sintering). Other processes use ink-jet printing heads to place binder material into powdered metal, ceramic or polymer. Another method uses UV light to harden a photosensitive polymer.

Compared to traditional manufacturing, 3D-printing processes have advantages such as part complexity, digital design and manufacturing, and waste reduction. As a deposition technology, 3D-printing provides means for the development of new products for the defense and aerospace industry. Compared to conventional methods for part production, 3D-printing brings the benefit of reducing the part count, decreasing assembly times, thus reducing costs and cycle time production. Replacement of traditional manufacturing methods by 3D printing techniques provides the ability to fabricate very complex customized objects without long lead times and special tooling.

Figure 1:
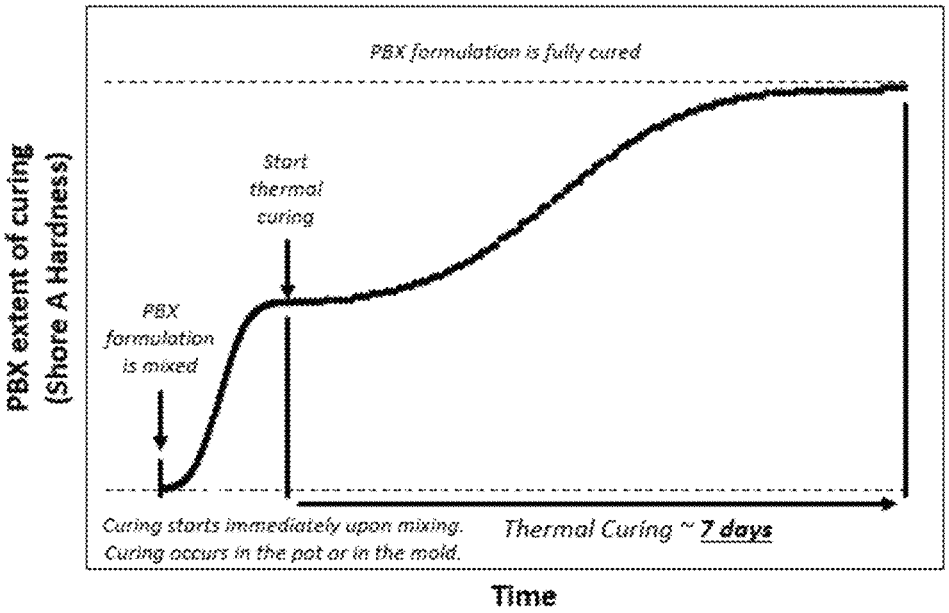
FIG. 1 (PRIOR ART)
FIG. 1 is a plot that is an illustrative description of the conventional process of the prior art by which PBX is prepared. The bottom left of the graph illustrates the curing upon mixing problem. As soon as the components are mixed, the PBX formulation starts to polymerize or cure. At this point the formulation is "in the pot" and has not been poured into the mold or is the process of being poured into multiple molds. In addition, the time required to fully cure a conventional PBX formulation is too long. This situation is expected using the HTPB/isocyanate system which is the convention in PBX manufacture. Such a reaction system is unsuited to 3D printing where flow characteristics should be maintained up until the material is dispensed
Figure 2:
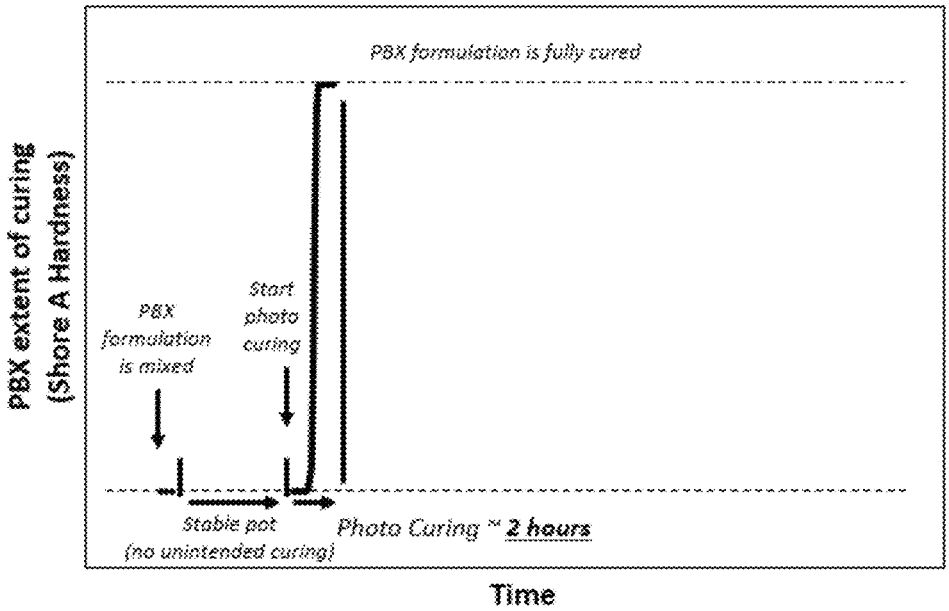
FIG. 2 is a plot that shows an illustrative description of the advantages of the invention on the same scale as graphed in FIG. 1 for comparison. The bottom left of the graph illustrates that the "pot" is stable (i.e. the viscosity does not increase with time). Specifically, polymerization of the formulation does not start when the components are mixed allowing ample time to either pour multiple molds or 3D-print PBX shapes on an as-needed basis. The graph also illustrates that photo curing of the formulation is much faster than the conventional process (2 hours versus one week). Such a situation could be achieved using a version of the HTPB binder but which has a reduced ability to undergo chemical cross linking when the energetics components are mixed prior to dispensing.

The present invention describes a series of pot-stable PBX formulations in which rapid curing can be triggered through the application of light at specific wavelengths (direct or diffuse, coherent or incoherent). This is illustrated in FIG. 2. The graph plots PBX extent of curing (i.e. Shore A Hardness) as a function of Time on the same scale as the conventional preparation process described in FIG. 1. The bottom left corner of FIG. 2 illustrates that curing of the PBX formulation, once prepared, does not increase with time. Specifically, we have observed that once the pot-stable formulation was prepared, no measurable change in viscosity was observed when the solution is stored at room temperature in the dark for at least 48 hours.

This is described as a "stable pot" and allows ample time to either pour multiple molds or 3D-print PBX shapes on an as-needed basis. This is in sharp contrast to the conventionally prepared formulation in which a noticeable and significant change in formulation viscosity occurs within a few hours of preparation. The graph also illustrates that photo curing of the new formulations occurs much faster that thermal curing of the conventional formulations (~2 hours versus 1 week for thermal curing of the conventional formulation).

A pot-stable formulation that can be rapidly photo cured provides numerous advantages. The pot-stable PBX formulations described are compatible with additive manufacturing techniques or 3D printing which will facilitate the generation of complex shapes and structures that may be difficult or impossible to be made with conventional casting, pressing, extruding, or molding. Another advantage of the 3D-printing of PBX formulations is that the prototype scale and the production scale are the same, and both scales are relatively small even for large prints.

This simplifies the safety testing and qualification significantly as changing the product size and geometry does not change the process or process safety and should not require re-qualification.

Figure 5:
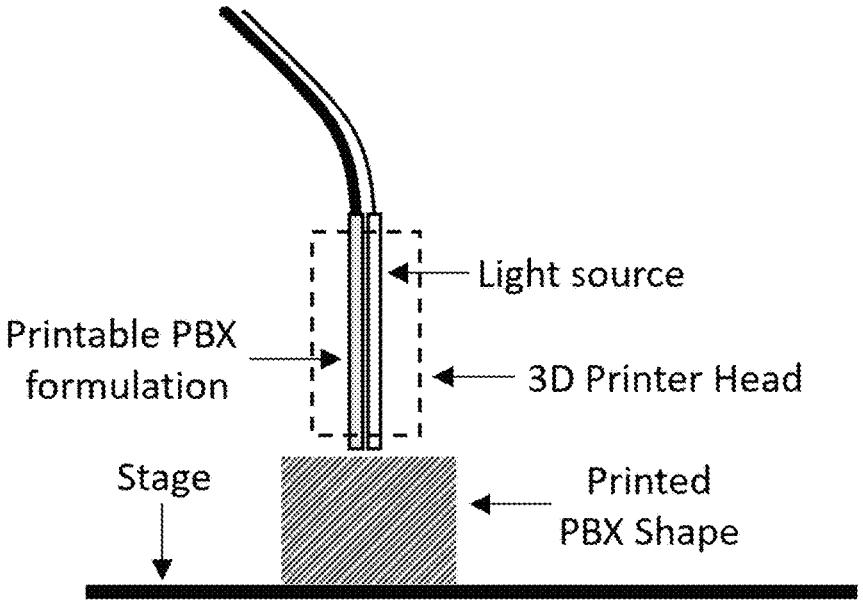
FIG. 5 shows a device for photopolymerized 3D printing of PBX formulations.

FIG. 5 shows a device for photopolymerized 3D printing of PBX formulations.

The preferred characteristics of the PBX formulations are:

1. they exhibit extensive pot-life stability (i.e. polymerization of the PBX formulation does not start when the components are mixed);
2. they exhibit the required viscosity to be dispensed in a commercially available 3D printer;
3. the curing process is initiated in situ during printing using a laser or after the shape is completely formed using a bulk light box;
4. the curing process is rapid (typically is complete in less than 2 hours).

It is important to understand that the development of new formulations was required to exploit the advantages of 3D printing PBX shapes. 3D-printing using current formulations that have been optimized for a cast-cure process is constrained by many inherent characteristics and limitations.

1. Cast-cure formulations have limited pot-life, possibly less than the time required to print a complete motor or warhead.
2. Curing is generally an exothermic process and the temperature profile will be strongly influenced by the geometry of the shape that is cast. For example, the distance to various heat sources/sinks. A cast and thermally-cured PBX formulation may yield the desired shape and properties but only at that scale. A larger version of the same shape will have different surface area to volume ratios and will heat or cool at different rates than the smaller shape which will change the properties of the PBX created at the larger scale. Consequently, the formulation must be optimized at each scale, either because of issues encountered during mixing or during casting.
3. Since the polymerization process of conventional formulations are exothermic, a poorly-optimized PBX formulation may lead to thermal runaway. A formulation cast at a small scale may yield the desired PBX but a larger cast of the same formulation may generate too much heat that cannot be dissipated fast enough. A thermal runaway may lead to poor mechanical characteristics, poor aging performance, or even autoignition and deflagration-to-detonation transition.

If instead the curing is achieved by a process with full spatiotemporal control, then these issues are completely mitigated. One way of achieving this is to irradiate the PBX formulation as it is extruded from a printing nozzle, triggering a controlled polymerization/cross-linking process. If the uncured material is thermally stable and kept in the dark, then effectively unlimited pot life is achieved. Because the cure volume is highly localized and nearly constant in size for a given extrusion head, cure characteristics do not depend on the presence/absence of adjacent structures, mitigating variability of performance and risk of thermal runaway. As such, once a particular formulation has been validated for a particular nozzle, the combination is capable of printing objects at any scale supported by the printer.

Formulations may be conceived wherein the uncured formulation is, for practical purposes, indefinitely storable, and which are extremely insensitive to stimuli (e.g. shock, impact, heat, compression, electrostatic discharge), but which achieve a practical and useful degree of sensitivity upon curing and manufacture into a munition. Such a formulation would have significant benefits for expeditionary, far-forward, shipboard, or on-demand manufacture of munitions.

EXAMPLES

Formulation 1. Chemical Modification of HTPB to Yield a Photocurable Polymer

This formulation was developed to generate a pot-stable, rapidly photocurable polymer-bonded explosive composition that retains many of the desirable physical characteristics of conventionally prepared polymer-bonded explosive compositions. Since hydroxy-terminated polybutadiene (HTPB) is commonly used as a polymer binder, this formulation starts with the conversion of HTPB into a photocurable polymer by derivatizing free hydroxyls in R-45M HTPB with acryloyl chloride to yield the acrylyl hydroxyl-terminated polybutadiene (ATPB). The steps to generate the pot-stable, photocurable PBX using Formulation 1 include:

1. Chemically convert HTPB to ATPB
2. Mix ATPB, Energetic, and Photoinitiator
3. Photopolymerize mixture with 405 nm light These three elements of the invention are described below.

Figure 6:
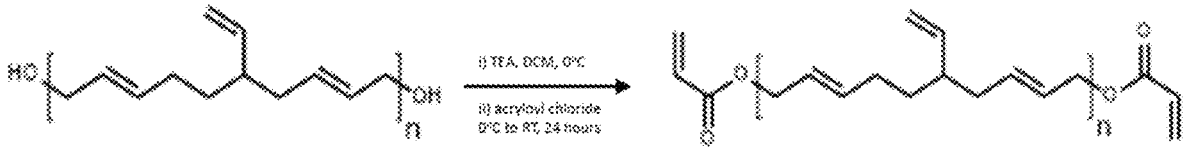
FIG. 6 is a diagram that shows a reaction scheme that modifies the R45M HTPB to ATPB.

Chemically convert HTPB to ATPB—FIG. 6 illustrates the reaction to convert HTPB to ATPB. Hydroxyl terminated polybutadiene (R-45M, 50 g, 0.178 mol) and triethylamine (1.7 g, 0.0178 mol) are mixed in anhydrous methylene chloride (DCM, 200 mL) at 0° C. to which acryloyl chloride (3.48 mL, 0.0384 mol) is added dropwise over a 30-minute period. The reaction mixture is stirred for 4 hours at 0° C. and allowed to reach room temperature over a 24-hour period.

The reaction mixture is then washed with sodium bicarbonate solution and brine solution four (4) times to remove unreacted starting material and the triethylamine hydrochloride salt. The organic layer is then dried over anhydrous magnesium sulfate and removed via rotary evaporation, providing a yellow viscous liquid. Desired compound can be confirmed by FT-IR and $^1$H NMR.

Figure 7:
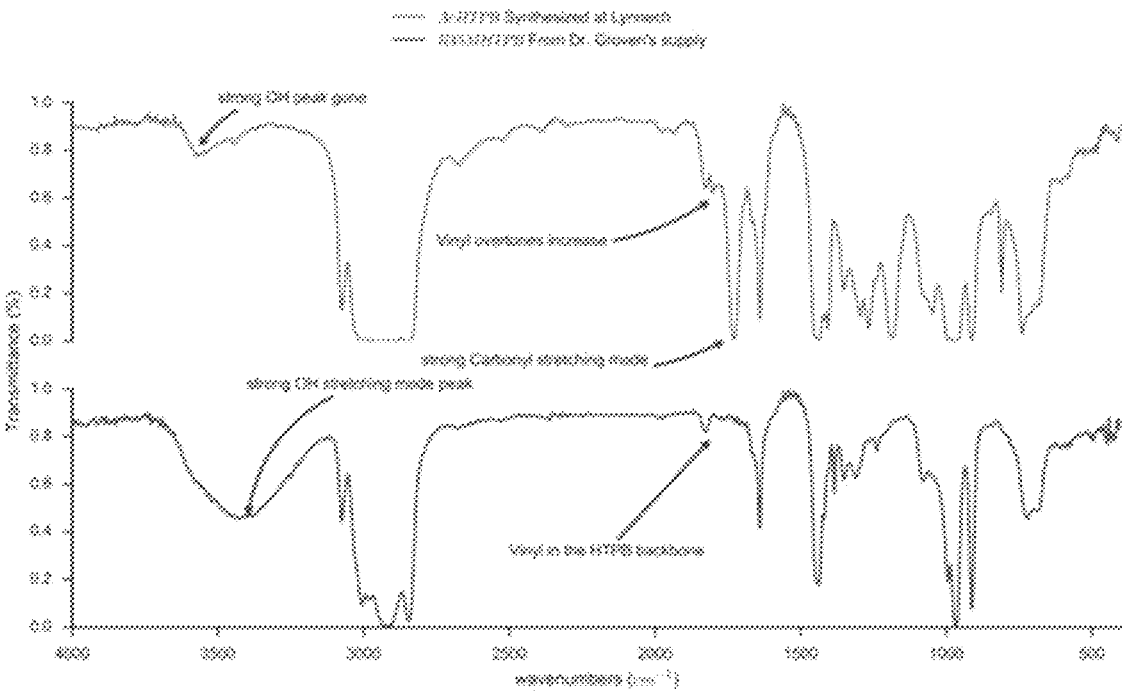
FIG. 7 is a plot that shows the transmittance vs. wavenumber for HTPB and ATPB taken on a Bruker Tensor 27 FTIR Spectrometer.

FIG. 7 presents a plot of transmittance vs. wavenumber for HTPB and ATPB taken on a Brucker Tensor 27 FTIR Spectrometer. For ATPB, the spectrum shows the appearance of a strong carbonyl stretching mode at ~1750 cm$^1$ (sharp peak) associated with the acrylate group and the disappearance of the hydroxyl stretching mode at ~3500 cm (broad peak). This is an excellent indicator that the hydroxyls of HTPB have indeed been acrylated to form ATPB.

Figure 8:
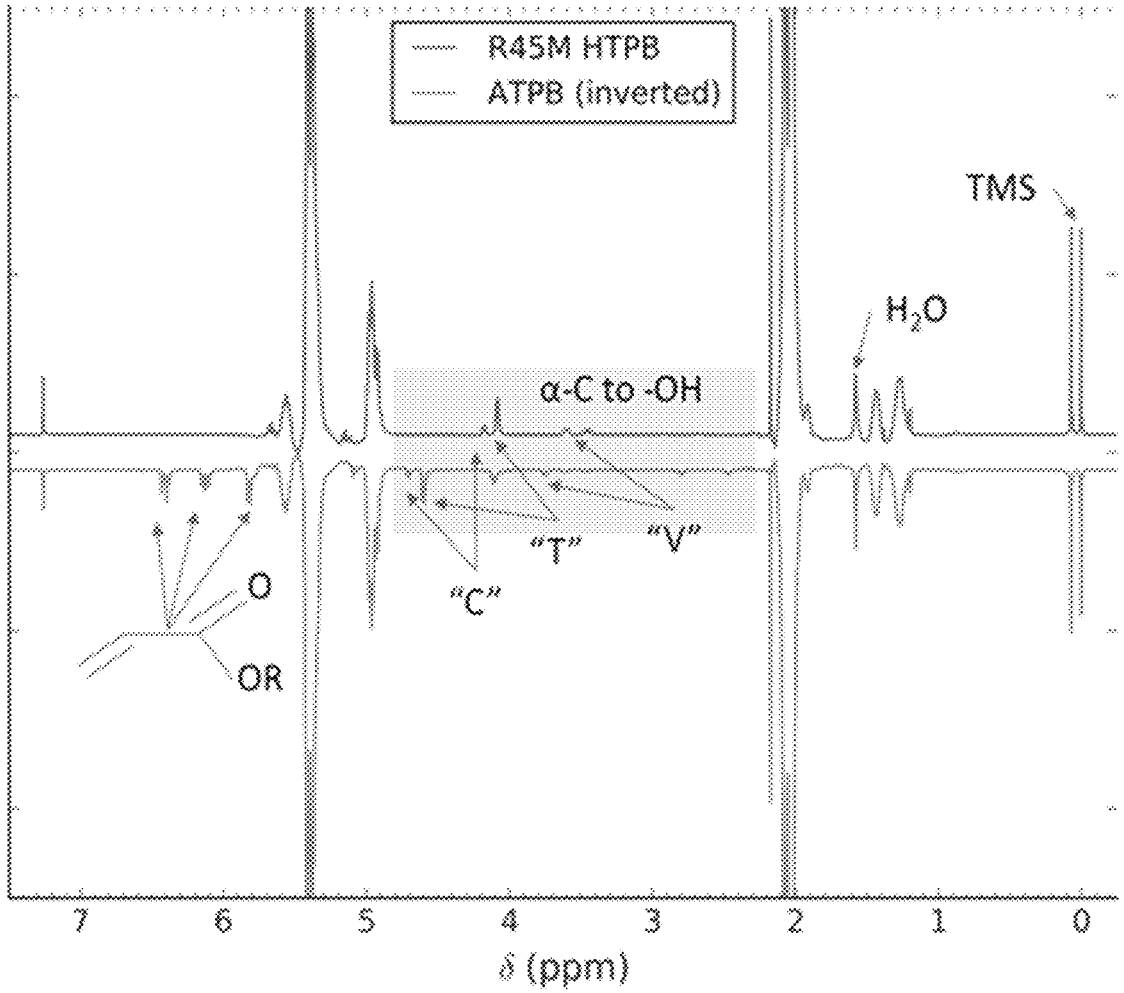
FIG. 8 is a plot that shows the NMR spectra of HTPB and ATPB.

This is further corroborated by the NMR data, shown in FIG. 8. To identify the product and further qualify the functionalization procedure, 1H NMR was conducted for both HTPB and ATPB (blue and green, respectively, in FIG. 2). The peak at 7.26 is from $CHCl_3$ present as an impurity in the deuterated solvent used to take the NMR ($CDCl_3$), the peak at 1.26 is water, and the peaks around 0 are from TMS used as a standard and a contaminant, silicone grease. Alkenyl protons appear as peaks from ~4.8-5.6, with those at 5 representing vinyl branches off the main chain. The large peaks at 2 represent the allylic protons, while the peaks at ~1.2 and ~1.4 are protons that are α-allylic. Due to water in the sample (~1.6), the hydroxyl protons cannot be seen.

However, the α-hydroxy protons can be seen as the small peaks in the region of 3-4.7 (labeled C, T, and V). In going from HTPB to ATPB, these peaks have shifted further downfield, as expected from esterification. In addition, the only other change is the appearance of the protons from 5.7-6.4. These three multiplets are from the terminal acrylate protons, each peak representative of one proton on the acrylate group. In summary, the NMR and FTIR clearly show nearly complete functionalization of HTPB with acrylate to form ATPB.

Mix ATPB with Energetic and Photoinitiator—This step involves preparation of a photocurable PBX mixture with preferable characteristics for 3D printing. An example UV cure formulation includes: 20 wt % binder composition and 80 wt % ammonium perchlorate (47.6 wt %<25 μm fine AP/52.4 wt % 90 μm coarse AP) with a target batch size of 50 grams of total mixture. The ATPB (~50 g) is first measured in a small container for the Thinky planetary centrifugal mixer. Previously prepared Irgacure 819 solution (200 mg/mL in toluene, 0.63 mL) is then added to the container containing ATPB. Lastly for the binder system, the container is placed in the Thinky mixer at 2000 rpm for one minute, rested for two minutes, and then placed back in the Thinky mixer for one minute at 2000 rpm. Next, the <25 μm fine AP is added to the container with the mixed binder system and placed in the Thinky mixer at 2000 rpm for one minute. After waiting five minutes for the mixture to cool, the 90 μm coarse AP is then added to the container and placed in the Thinky mixer at 2000 rpm for one minute. At this point, temperature may become a concern due to the heat generated during mixing. Measure temperature to ensure it remains <60° C. The formulation is put in the Thinky mixer one last time at 2000 rpm for one minute to ensure complete mixing.

This endgroup-modified formulation is less viscous at all temperatures than that of the analogous conventional cast-cure formulation (see FIG. 11). Specifically, the ATPB formulation at 20° C. is 4× less viscous than the HTPB formulation at the same temperature, or comparable in viscosity to the HTPB formulation at 42° C. This is beneficial in some applications of the technology to improve flow characteristics through the extrusion mechanism, to improve the safety factor of the printing process by reducing the operating temperature, or both.

Photopolymerize mixture with 405 nm light—Generally speaking, in terms of product properties, laser initiated reactions are indistinguishable from their conventionally initiated counterparts. Because the laser-initiated process follows the same kinetic pathway as conventional systems, the overall rate is limited by reaction kinetics. Therefore, once saturation is achieved at an intensity of approximately 100 mW $cm^{-2}$, a highly consistent cure profile is obtained for photoinitiated polymerizations, regardless of inconsistencies in pulse time or intensity. The 'light-box' ovens constructed for this effort only achieve 30 mW $cm^{-2}$, and the laser sources only produce 5 mW $cm^{-2}$, which may or may not achieve instantaneous saturation. Heating occurs because of this process; however, if short pulse times are employed or the overall power delivered is lowered, the temperature rise due to light absorption is negligible compared to the exotherm of the subsequent polymerization or crosslinking processes. As a result, illumination from sources spanning 6 orders of magnitude in intensity has been observed to produce similar polymerization profiles. The greatest benefit of laser induction, then, is the deeper penetration obtained at high intensities. This is intended to allow us to enhance interlayer adhesion in the printed products by initiating polymerization to a depth that exceeds the printed layer height causing cross-linking across printed layers.

The UV LED can be a 1200 $in^3$ (12"×10"×10") Styrofoam cooler with a Chanzon 100 W LED Chip mounted on the top center lid. The LED is liquid cooled with an external radiator with forced air flow. The maximum power at the center is 30 mW, falling about 60% at the edges of the floor. The power distribution quickly falls off for measurements normal to the sides, measuring only within 3.5-4 mW. An increase in the uniformity of the power can be achieved by, e.g., maximizing reflections in the cavity.

A 5 mW 405 nm laser was positioned on a tracking stage. The stage allowed for several configurations of beam size to cover the full samples for various periods of time, thus controlling the total dose. Depending on the sample size, the laser spot can be varied to including spatial filters and ND filters if necessary (not shown). Depending on the required dose, the sample stage is moved directly over each successive sample for the necessary exposure to test curing, dose is controlled via electronic switching of the laser in this example design but is amenable to both spatial and temporal controls like those of a laser cutter or powder-bed sintering 3D printer system.

The inventors used mixing and extrusion equipment to produce small samples of inert material using an RDX stimulant. This in-house testing was then used to verify that the material extrusion and curing procedure work as designed before moving on to perform this work on an explosive feedstock. Mixing was guided by the team's experience in prior work, and printed using a (Nordson EFD 200 mm×200 mm robot). The inventors cast simple shapes, including 'dogbone' shapes based on the ASTM micro-dogbone standard, which allow easy mounting to mechanical strain meters. These shapes are small enough that the print-bed in can print as many as 3 with sufficient spacing between them to allow for adhesion rafts or skirts and other commonly required print-quality enhancing features on the print bed at once. The inventors produced tens of dogbones from Formulation 1 (ATPB), as well as two independent print jobs of a conic shape consisting of overlapping arc segments, approximately 1 inch in diameter at the base and free standing to a height of approximately 2 inches. Standard mixtures were also cast in the dogbone shape and cured to allow for direct comparison of mechanical properties. Additionally all formulations were cast as rods for cutting into the necessary length for strand burn testing.

Manufacture of an energetic article by this method will generally proceed along a common overall course, with significant variations in viable implementation for each step. The high-level process is described by several distinct steps. The steps may occur in the strict sequence presented below, or, more typically, some of the steps are concomitant or simultaneous. In some cases, steps may be omitted, or rearranged. The steps are: i) synthesis; ii) formulation; iii) dispensing; iv) forming; v) curing.

Synthesis of energetics materials, stabilizers, and typical (pre-)polymers are well understood by those versed in the art, and will not be described in further detail. An exception is made for the synthesis of some photoactive materials and/or (pre-)polymers. [Refer to or include appropriate section here]

Formulations work is necessary to attain desired performance characteristics for any composite material, and energetics are no exception. While those versed in the art will be familiar with the common compositions and mixing methods utilized, the inventors have described the mixing process for baseline energetic formulations to contrast the methodology associated with this invention.

Controlled dispensing of the materials is a typical requirement for this process. Myriad implementations for material dispensing are possible, and desirable for specific applications. The dispensing mechanism could be an actively powered system (e.g. auger screw drive, syringe pump, or aerosol spray applicator), pre-charged (such as with a piston-driven pneumatic dispenser, as used in Easy Cheese™ and similar spray cheese products, or with pre-charged aerosol can), or manually powered (e.g. hand-cranked auger screw, syringe, or piping bag/pastry bag). In general, non-sparking, electrostatic dissipating/conductive materials are preferred for energetic formulations, to prevent unintended initiation. For similar reasons, processes which limit shearing and grinding of the formulation are preferred. [Refer to or include appropriate section here]

Forming of the dispensed material into the desired shape is typically concomitant with that step. Specifically, a motion control system is generally utilized to arrange the dispensing head and the article with respect to each other to achieve the desired shape, using the methods of those versed in that art of additive manufacturing. Human, computer, or mechanically controlled systems could be utilized, with or without positional feedback (i.e. open loop or closed loop). This does not preclude the use of other methods, such as formation into shapes controlled by physical barriers (i.e. injection molding), rheological and interfacial properties (i.e. spot application on a surface), or other methods.

The (photo)curing process can occur simultaneously, interleaved, and/or sequentially with the dispensation steps. Of these, simple sequential photocuring is generally least preferred, as photocuring of the entire printed article is the process most affected by variability in article size, and presents the greatest risk of a thermal runaway event. However, if applied as a post-processing step to an article that was already partially cured by a simultaneous and/or interleaved process, a sequential curing may be used to ensure highly-uniform curing obtained with minimal risk. For each of these photocuring processing steps, the applied illumination may: i) be local, regional, or globally applied; ii) monochromatic or polychromatic; iii) coherent, partially coherent, or incoherent; iv) linearly polarized, circularly polarized, or unpolarized; v achieve spatial control over curing region through use of multiple illumination source; vi) achieve super-resolution through the use of multi-photon absorption phenomena.

Formulation 2. Reversible Addition-Fragmentation Chain Transfer (RAFT) Polymerization of ATPB.

One technical difficulty of additive manufacturing is obtaining full-strength interlayer adhesion. In thermoplastics, this generally requires that the melt layer be deposited at a sufficiently hot temperature and with sufficient thermal mass such that the preceding layer is partially re-melted (or is never allowed to fully set before adding the subsequent layer) to provide complete interdigitation of the polymer chains. For a photoset plastic, an equivalent process is found in reversible addition-fragmentation chain transfer (RAFT), a type of living free-radical polymerization. Living polymers make layer-by-layer deposition and curing of photoset plastics potentially superior to direct photo-polymerization systems (as in Formulation 1), because of their ability to promote crosslinking of freshly printed material to existing, previously cured layers.

Trithiocarbonate, which can be photoactivated to induce RAFT polymerization of acrylates, have also been demonstrated as useful additives in energetic formulations. In this example, trithiocarbonate was used to induce photoactivation of RAFT polymerization of the ATPB polymer described in Example 1. The steps to generate the pot-stable, photocurable PBX using Formulation 1 include:

1. Chemically convert HTPB to ATPB
2. Mix ATPB, Energetic, Trithiocarbonate, and Photoinitiator
3. Photopolymerize mixture with 405 nm light 1. Chemically convert HTPB to ATPB—Identical to the method described in Formulation 1. Briefly, the reaction to convert HTPB to ATPB begins with hydroxyl terminated polybutadiene (R-45M, 50 g, 0.178 mol) and triethylamine (1.7 g, 0.0178 mol) being mixed in anhydrous methylene chloride (DCM, 200 mL) at 0° C. to which acryloyl chloride (3.48 mL, 0.0384 mol) is added dropwise over a 30-minute period. The reaction mixture is stirred for 4 hours at 0° C. and allowed to reach room temperature over a 24-hour period.
2. Mix ATPB, Energetic, Trithiocarbonate, and Photoinitiator—An example UV cure formulation includes: 20 wt % binder composition and 80 wt % ammonium perchlorate (47.6 wt %<25 μm fine AP/52.4 wt % 90 μm coarse AP) with a target batch size of 50 grams of total mixture. The ATPB (~50 g) is first measured in a small container for the Thinky planetary centrifugal mixer. Previously prepared Irgacure 819 solution (200 mg/mL in toluene, 0.63 mL) and diphenyl trithiocarbonate solution (500 mg/mL in toluene, 0.63 mL) are then added to the container containing ATPB. Lastly for the binder system, the container is placed in the Thinky mixer at 2000 rpm for one minute, rested for two minutes, and then placed back in the Thinky mixer for one minute at 2000 rpm. Next, the <25 μm fine AP is added to the container with the mixed binder system and placed in the Thinky mixer at 2000 rpm for one minute. After waiting five minutes for the mixture to cool, the 90 μm coarse AP is then added to the container and placed in the Thinky mixer at 2000 rpm for one minute. At this point, temperature may become a concern due to the heat generated during mixing. Measure temperature to ensure it remains <60° C. The formulation is put in the Thinky mixer one last time at 2000 rpm for one minute to ensure complete mixing.
3. Photopolymerize mixture with 405 nm light—Identical to the method described for Formulation 1. Briefly, the reaction to convert HTPB to ATPB begins with hydroxyl terminated polybutadiene (R-45M, 50 g, 0.178 mol) and triethylamine (1.7 g, 0.0178 mol) being mixed in anhydrous methylene chloride (DCM, 200 mL) at 0° C. to which acryloyl chloride (3.48 mL, 0.0384 mol) is added dropwise over a 30-minute period. The reaction mixture is stirred for 4 hours at 0° C. and allowed to reach room temperature over a 24-hour period.

Formulation 3. Chemical Modification of HTPB with a Photolabile Protecting Group.

A low risk, but also low-innovation technique was proposed as a backup option should all other options fail. This method is close to already approved Navy formulations, relying on urethane curing of HTPB. The inventors protect the system from spontaneous curing when mixed with isocyanates by 'caging' the terminal hydroxy groups in the following way. Hydroxy terminated polybutadiene (R-45M, 5 g, 0.00178 mol) and sodium hydride (51 mg, 0.002136 mol) were mixed in anhydrous methylene chloride (250 mL) at 0° C. to which 4,5-dimethoxy-2-nitrobenzyl bromide (1.18 g, 0.00428 mol) was added dropwise over a 30 minute period. The reaction mixture was stirred at 0° C. and allowed to reach room temperature over a 24 hour period. The reaction mixture was then cooled to 0° C. and quenched with 500 μL of methanol. The solution was then washed with a saturated aqueous solution of ammonium chloride and brine solution four (4) times. After the organic layer was reduced via rotovap, hexanes was then added to the crude product to precipitate out unreacted 4,5-dimethoxy-2-nitrobenzyl bromide. The unreacted starting material was filtered and the organic layer was then dried over anhydrous sodium sulfate. Volatiles were removed via rotovap, providing an orange viscous liquid. The desired compound was confirmed by FT-IR and 1H NMR. Urethane polymer chemistries, in general, are based on the reaction between the alcohol and isocyanate functional groups. By protecting the hydroxyl terminal groups of HTPB, they become unavailable for reaction with any isocyanates present. Upon illumination with the appropriate wavelength of light, the hydroxyl moiety is deprotected and is able to then react with isocyanate in the traditional way.

The method to generate PBX using this formulation is similar to the commonly used urethane curing of HTPB. The challenge with the commonly used method is that curing (polymerization) spontaneously occurs when isocyanates are added the formulation. This in situ polymerization during the fill stage results in a solidified composition that contains air bubbles, non-homogeneous crosslinking, and solidification of the "pot" of explosive before all munitions or molds have been filled, all of which are undesirable. By delaying the onset of crosslinking through a photocontrolled deprotection step, all of these problems may be mitigated. In this formulation, hydroxyls of the R-45M HTPB polymer, which participate in the urethane curing is modified with a photo-labile protecting group.

Once the formulation is homogeneously mixed and formed into the desired shapes (by 3D printing or other method), curing (polymerization) is triggered by the illumination of the shape with light to remove the protecting group and expose the HTPB hydroxyl groups allowing the traditional urethane curing of HTPB to occur. The steps to generate the pot-stable, photocurable PBX using Formulation 3 include:

1. Chemical protection of terminal hydroxyl of HTPB polymer
2. Mix Protected HTPB and Energetic
3. Add diisocyanate
4. Photopolymerize mixture with 405 nm light Two issues were noted in testing. First, the "control" experiment, which excluded step 4 (photodeprotection) still resulted in complete polymerization of the material. While the inventors cannot rule it out, the inventors do not suspect incomplete protection of the terminal hydroxyls is the culprit, as $^1$H NMR and FTIR indicates complete conversion of the endgroups. Second, the surface of the experimental dogbone was tacky and never achieved full cure on surfaces exposed to air. The inventors attribute this to consumption of the isocyanate crosslinker by moisture, though the inventors cannot rule out oxygen-inhibition of the uncaging step.

Formulation 4. Photoactivation of Thiolene Click Polymerization of ATPB

The formulation uses thiolene Click chemistry in the polymerization of the PBX polymer binder. The Click chemistry terminology is derived from the reactions' high yield, stereoselectivity, high rate, and thermodynamic driving force. In this example, this formulation starts with ATPB, as in Formulations 1 and 2, but crosslinking is achieved through thiol-ene Click chemistry which is activated by the photoinitiator. This chemistry is topologically like urethane chemistry, in that each acrylate group tends to only react with one of the two thiols in the dithiol crosslinker (akin to the polyol-diisocyanate system for HTPB), producing linear chains, and reducing the cross-linking density back to approximately 2.5. The steps to generate the pot-stable, photocurable PBX using Formulation 4 include:

1. Chemically convert HTPB to ATPB—Identical to the method described for Formulation 1.
2. Mix ATPB, Energetic, 1,3 Benzenedithiol, and Photoinitiator—An example UV cure formulation includes: 20 wt % binder composition and 80 wt % ammonium perchlorate (47.6 wt %<25 μm fine AP/52.4 wt % 90 μm coarse AP) with a target batch size of 50 grams of total mixture. The ATPB (~50 g) is first measured in a small container for the Thinky planetary centrifugal mixer. Previously prepared Irgacure 819 solution (200 mg/mL in toluene, 0.63 mL) and 1,3 benzenedithiol solution (500 mg/mL in toluene, 0.63 mL) are then added to the container containing ATPB. Lastly for the binder system, the container is placed in the Thinky mixer at 2000 rpm for one minute, rested for two minutes, and then placed back in the Thinky mixer for one minute at 2000 rpm. Next, the <25 μm fine AP is added to the container with the mixed binder system and placed in the Thinky mixer at 2000 rpm for one minute. After waiting five minutes for the mixture to cool, the 90 μm coarse AP is then added to the container and placed in the Thinky mixer at 2000 rpm for one minute. At this point, temperature may become a concern due to the heat generated during mixing. Measure temperature to ensure it remains <60° C. The formulation is put in the Thinky mixer one last time at 2000 rpm for one minute to ensure complete mixing.
3. Photopolymerize mixture with 405 nm light—Identical to the method described in Example 1.

Formulation 5. Chemical modification of a fluoropolymer to yield a photocurable fluoropolymer. The purpose of this formulation was to demonstrate the photocuring of fluoropolymers in PBX formulations. Fluoropolymers are advantageous as binders due to their high density (yielding high detonation velocity), inert chemical behavior (yielding long shelf stability and low aging), and superior adhesion (wetting) of the filler (improves bonding between filler and binder). In this example, Lumiflon® LF600X (AGC Chemical Company, Tokyo, Japan) was used as the starting material for the preparation of a photocurable fluoropolymer using the same chemistry used to convert HTPB to ATPB. The steps to generate the pot-stable, photocurable PBX using Formulation 5 include:

1. Chemically convert Lumiflon® LF600X to the acrylyl-terminated Lumiflon® LF600X derivative (A-LF600X). In a typical procedure, Lumiflon LF-600X (12 g, 0.0122 mol OH) is dissolved in dichloromethane (100 mL) in a round bottom flask. The reaction is placed under argon and cooled to 0° C. in an ice/water bath. Triethylamine (2.0 mL, 1.45 g, 0.0144 mol) is added to the mixture under constant stirring and then acryloyl chloride (2.4 mL, 2.69 g, 0.0297 mol) is slowly added. The reaction mixture is maintained at 0° C. for 3 hours and allowed to continue at room temperature for another 12 hours.

Once the reaction was completed, the reaction mixture was purified with four successive liquid-liquid extractions, each time with a solution of 10% sodium bicarbonate (150 mL). The organic phase was recovered and dried over anhydrous magnesium sulfate, and then filtered on a Buchner funnel. The filtrate is then concentrated in vacuo at 40° C. on a rotary evaporator. The product was thus obtained as a viscous yellow liquid.

2. Mix A-LF600X, Energetic, and Photoinitiator. This step involves preparation of a photocurable PBX mixture with preferable characteristics for 3D printing. An example UV cure formulation includes: 20 wt % binder composition and 80 wt % ammonium perchlorate (47.6 wt %<25 μm fine AP/52.4 wt % 90 μm coarse AP) with a target batch size of 50 grams of total mixture. The A-LF600X (~50 g) is first measured in a small container for the Thinky planetary centrifugal mixer. Previously prepared Irgacure 819 solution (200 mg/mL in toluene, 0.63 mL) is then added to the container containing A-LF600X. Lastly for the binder system, the container is placed in the Thinky mixer at 2000 rpm for one minute, rested for two minutes, and then placed back in the Thinky mixer for one minute at 2000 rpm. Next, the <25 μm fine AP is added to the container with the mixed binder system and placed in the Thinky mixer at 2000 rpm for one minute. After waiting five minutes for the mixture to cool, the 90 μm coarse AP is then added to the container and placed in the Thinky mixer at 2000 rpm for one minute. At this point, temperature may become a concern due to the heat generated during mixing. Measure temperature to ensure it remains <60° C. The formulation is put in the Thinky mixer one last time at 2000 rpm for one minute to ensure complete mixing.
3. Photopolymerize mixture with 405 nm light—Identical to the method described in Formulation 1. Mechanical Properties. The mechanical properties of the photopolymerized formulations was measured and compared to control formulations using HTPB polymerized in the conventional manner using urethane chemistry and heat curing. An Instron-style tensile strength measurement system was used to characterize the tensile strength to the point of yield of the heat polymerized and photopolymerized compositions with and without filler.

Dog bones were made using various formulations. The inventors used two techniques to produce dogbones, they were cast into molds or cut from sheet. The materials were hand-mixed, cast, and cured in this diffuse, incoherent-source light-box for as much as 90 minutes.

Figure 9:
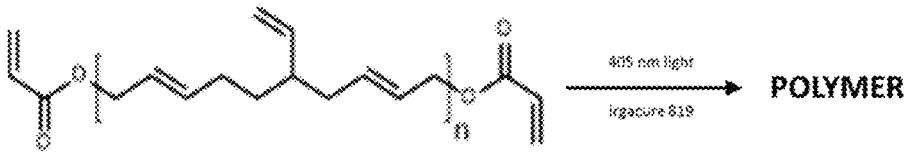
FIG. 9 is a diagram that shows the photopolymerization of APTB. The mixture described above is illuminated with 405 nm light to initiate polymerization.
Figure 12:
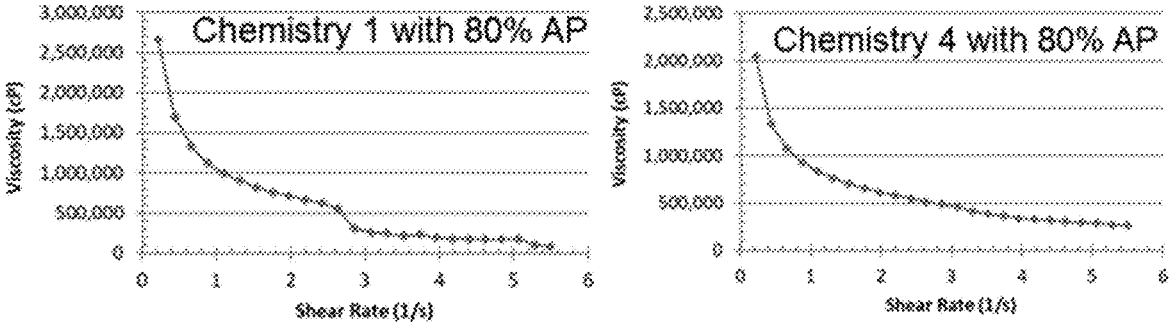
FIG. 12 includes two plots that show: APTB (left) and Click-ATPB (right) formulation with AP filler, the mixture is a shear-thinning fluid. This characteristic is desirable for both the additive manufacturing of PBX and for the more conventional methods of casting, pressing, extruding, or molding as it allows for finer feature resolution and lower energy input to the system during forming (before curing).
Figure 13:
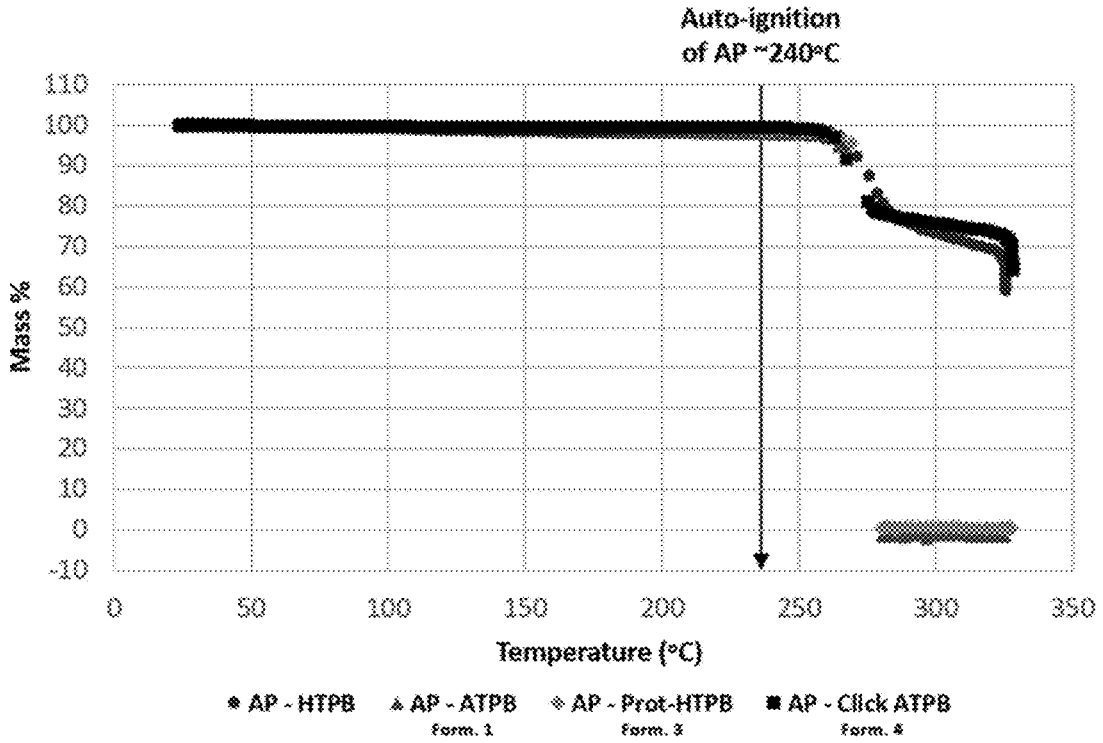
FIG. 13 is a plot that shows the raw mass loss versus temperature curves from thermogravimetric analysis of the materials as described in the legend. The heating was done at 10° C./min under a constant stream of nitrogen (20 mL/min). The photocurable formulations AP-ATPB and AP-Prot-HTPB exhibit very sharp and complete deflagrations at about 275° C.
Figure 14:
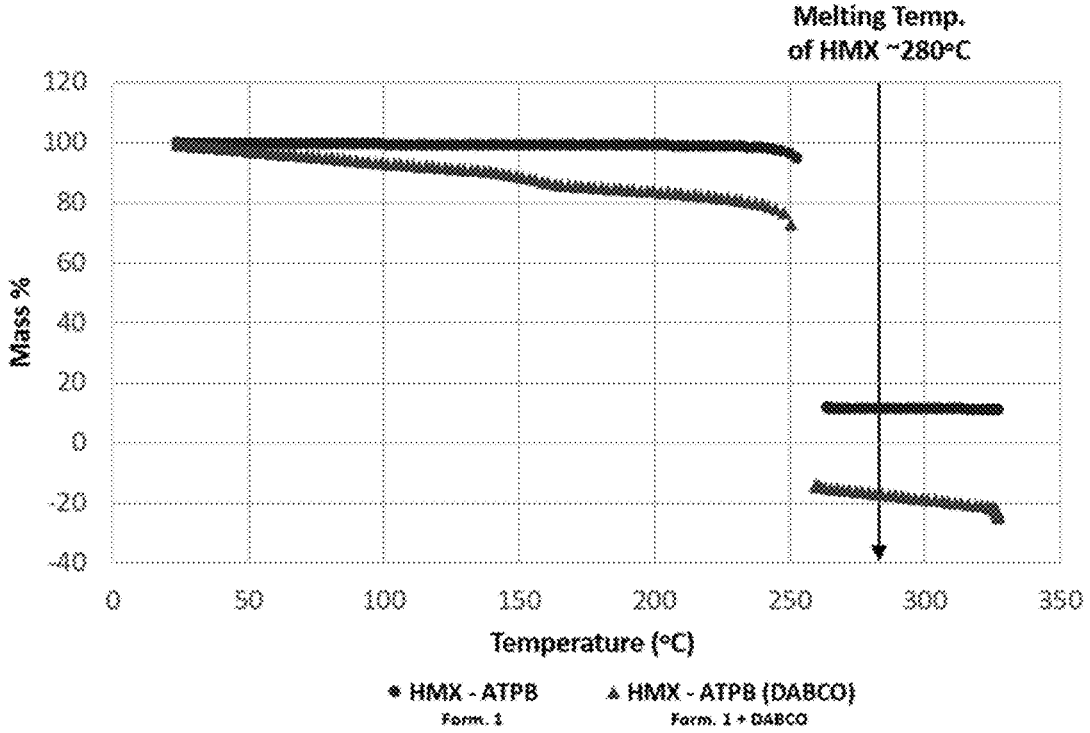
FIG. 14 is a plot that shows the raw mass loss versus temperature curves from thermogravimetric analysis of the materials as described in the legend. The heating was done at 10° C./min under a constant stream of nitrogen (20 mL/min). The photocurable formulations HMX-ATPB and HMX-ATPB (DABCO) exhibit very sharp deflagrations at about 260° C. The mass loss associated with the HMX-ATPB (DABCO) formulation between 20 and 250° C. is most like the result of a chemical reaction between HMX and DABCO making this additive unsuitable for the photocurable formulation. This deleterious effect is also observed when DABCO is added to conventional HMX-HTPB formulations.

The densities of the formulations were measure by extruding hand-mixed formulations into PTFE straws, curing, and then removing the straws, measuring and weighing the resulting product. These are also the articles used for the burn-rate testing and the DSC experiments. Many replicates of each formulation were made, varying between 3 and 9 per formulation for each test. The results are shown in Tables 1 to 3. The results show that the densities of the photopolymerized formulation with either AP or HMX filler are comparable to the densities of the corresponding urethane/heat cured HTPB control formulation. FIG. 9 is a diagram that shows the photopolymerization of APTB. The mixture described above is illuminated with 405 nm light to initiate polymerization. FIG. 10 includes two plots that show the stress strain curves for chemistry 1 with and without sieved/fractionated >200 μm NaCl crystal filler loaded at 80% by mass. FIG. 12 includes two plots that show: APTB (left) and Click-ATPB (right) formulation with AP filler, the mixture is a shear-thinning fluid. This characteristic is desirable for both the additive manufacturing of PBX and for the more conventional methods of casting, pressing, extruding, or molding as it allows for finer feature resolution and lower energy input to the system during forming (before curing). FIG. 13 is a plot that shows the raw mass loss versus temperature curves from thermogravimetric analysis of the materials as described in the legend. The heating was done at 10° C./min under a constant stream of nitrogen (20 mL/min). The photocurable formulations AP-ATPB and AP-Prot-HTPB exhibit very sharp and complete deflagrations at about 275° C. FIG. 14 is a plot that shows the raw mass loss versus temperature curves from thermogravimetric analysis of the materials as described in the legend. The heating was done at 10° C./min under a constant stream of nitrogen (20 mL/min). The photocurable formulations HX-ATPB and HMX-ATPB (DABCO) exhibit very sharp deflagrations at about 260° C. The mass loss associated with the H5X-ATPB (DABCO) formulation between 20 and 250° C. is most like the result of a chemical reaction between HMN/X and DABCO making this additive unsuitable for the photocurable formulation. This deleterious effect is also observed when DABCO is added to conventional HMX-HTPB formulations.

TABLE 1

The measured density of photopolymerized PBX materials are similar to the densities measured for the conventionally prepared AP/HTPB and HMX/HTPB PBX materials.

| Form. # | Binder Composition | Filler | Average Density ($g/cm^3$) | Standard Deviation |
|---|---|---|---|---|
| — | HTPB (control) | 80% | 1.57 | 0.029 |
| 1 | ATPB | AP | 1.58 | 0.039 |
| 3 | Protected - HTPB | | 1.54 | 0.022 |
| 4 | Click - ATPB | | 1.63 | 0.022 |
| -— | HTPB (control) | 80% | 1.55 | ND |
| 4 | Click - ATPB | HMX | 1.54 | ND |

TABLE 2

Mean Shore A Hardness and Young's Modulus for some of the examples.

| Form. # | Binder Composition | Filler | Mean Shore A Hardness | Young's Modulus (MPa) |
|---|---|---|---|---|
| 1 | ATPB | None | 15 | 0.03235 |
| 2 | RAFT - ATPB | | 10 | ND |
| 3 | Protected - HTPB | | 20 | ND |
| 4 | Click - ATPB | | 45 | 0.272050 |
| 1 | ATPB | 80% inert | 48 | 0.46933 |
| 4 | Click - ATPB | | ND | 1.8172 |
| 1 | ATPB | 80% AP | 65 | ND |

TABLE 2

Viscosities and the ability to photopolymerize various binder compositions.

| Form. # | Binder Composition | Filler | Viscosity @ 25° C. (Pa · s) | Photopolymerizable |
|---|---|---|---|---|
| — | HTPB (control) | None | 0.082019 | No |
| 1 | ATPB | | 0.023336 | Yes |
| 2 | RAFT - ATPB | | ND | Yes |
| 3 | Protected - HTPB | | ND | Yes |
| 4 | Click - ATPB | | ND | Yes |
| 5 | A-LF600X | | ND | Yes |
| 1 | ATPB | 80% | ND | Yes |
| 4 | Click - ATPB | HMX | ND | Yes |

The formulations are elastomeric, and from the stress/strain curves shown displays classic plastic deformation until failure. The composition with filler is stiffer and considerably grainer in nature than the composition without filler. This property can be tuned by changing the grain size of the additives or further modification of the binder/additive interaction.

Rheological characterization is also important for 3D printing formulations and the conventional methods of casting, pressing, extruding, or molding. The results in FIG. 11 show that across a broad working temperature the ATPB photocurable binder composition always has a lower viscosity than HTPB. In addition, after mixing either the APTB or Click-ATPB formulation with AP filler, the mixture is a shear-thinning fluid. Both the lower viscosity and the observed shear thinning property of the photocurable formulations make them more compatible with both 3D printing of PBX shapes and the more conventional methods of casting, pressing, extruding, or molding PBX shapes.

Burning Properties. Burn rate is affected by chamber pressure. The usual representation of the pressure dependence on burn rate is the Saint Robert's Law:

$$r=r_o+aPc^n$$

where r is the burn rate, $r_o$ is a constant (usually taken as zero), a is the burn rate coefficient, and n is the pressure exponent. The values of a and n are determined empirically for a particular propellant formulation, and cannot be theoretically predicted. The burn rate as a function of chamber pressure was determined for a variety of formulations.

The primary strand burner is capable of pressures in excess of 300 atm and contains the infrastructure for operating remotely, including electronically controlled pneumatic fill and exhaust valves. Current diagnostics include a pressure transducer, a digital video camera, a spectrometer (Ocean Optics), a high-speed Si photodetector (New Focus), and a Photron FASTCAM SA3 digital camera capable of up to 120,000 fps. The strand burner facility includes a windowed test section for optical access. Burning-rate information from the pressure transducer and photodiode are collected by a high-speed computer data acquisition system (Gagescope) capable of 5 MHz sampling at 12-bit resolution over two channels. A second strand burner has been recently constructed and is capable of pressures up to 670 atm (10,000 psi) and can be heated and cooled for assessing the effect of temperature on burning rates.

Solid energetic samples are mounted on the strand holder. Modifications can be made to the holder to allow for variations in sample size from different sources. The propellant sample is inhibited on all sides by a coating of liquid HTPB (except for the burning face), and it is ignited by a heated, nichrome wire. A remote-access control panel is used to fill the strand burner to the appropriate pressure, trigger the computer data acquisition system, ignite the propellant, and vent the gases at the end of the experiment. The fill gas is an inert gas such as argon. Burning rate is determined by carefully measuring the sample length and dividing by the measured time between propellant ignition and burnout from the pressure and light emission traces. More details on the experimental setup and procedure are contained in Carro et al., 2005 and Stephens et al., 2005. Carro, R., Arvanetes, J., Powell, A., Stephens, M. A., Petersen, E. L., and Smith, C. (2005) "High-Pressure Testing of Composite Solid Propellant Mixtures: Burner Facility Characterization," AIAA Paper 2005-3617, July. Stephens, M., Carro, G., Wolf, S., Sammet, T., and Petersen, E. (2005) "Performance of AP-Based Composite Propellant Containing Nanoscale Aluminum," AIAA Paper 2005-4470, July.

Figure 15:
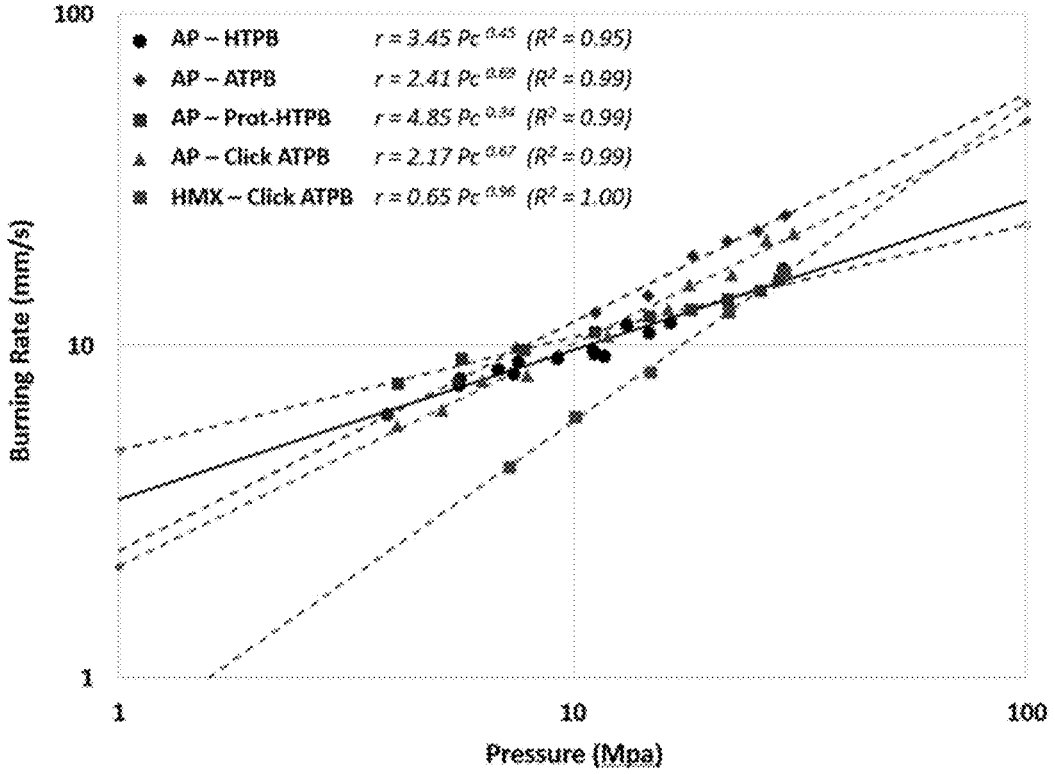
FIG. 15 is a graph that shows the burning rate versus pressure for the listed formulations.

The results are shown in FIG. 15. All formulations consisted of 20% polymer binder and 80% explosive filler. A control PBX formulation consisting AP and HTPB prepared in the conventional manner was included as a control for comparison purposes.

Polymer. The polymer can include up to the four following components: (1) backbone; (2) terminal groups; and (3) side chains, as shown in FIG. 16.

Figure 16:
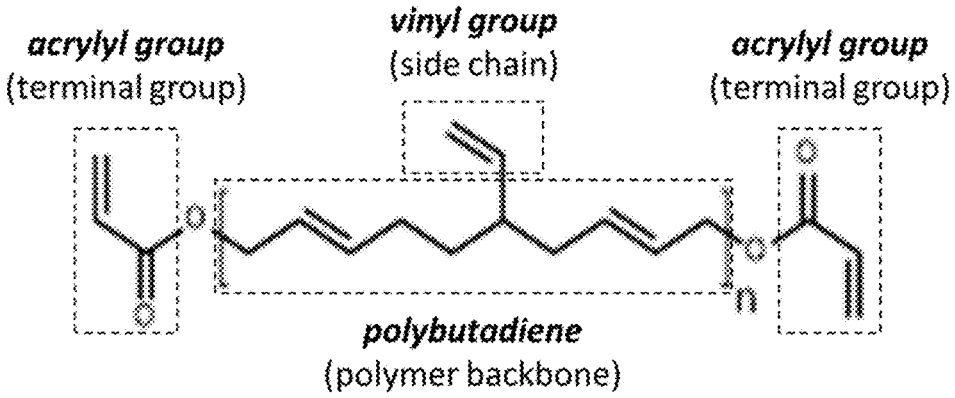
FIG. 16 is a diagram shows the basic shape of a polymer backbone and side groups for use with the present invention.

For illustration, the ATPB material that was synthesized for Formulation 1 is shown in FIG. 16, to help define the components of the polymer. ATPB does not have a side chain modifier which would be a modification to the side chain vinyl group.

Examples of the backbone (linear or branched) in the polymer include: polybutadiene, poly(butadiene-co-acrylonitrile), poly(azidomethyl ethylene oxide), poly(bis-azidomethyl oxetane), poly(nitratomethyl-methyl oxetane), poly(azidomethyl-methyl oxetane), poly(bis-nitratomethyl oxetane), poly(methylmethacrylate), polyacrylic acid, polystyrene, polytetrafluoroethylene, perfluoropolyether, poly (ethylene glycol), poly(propylene oxide), polycarbonate, polyethylene terephthalate, polyurethanes, vinyl polydimethylsiloxane, thiol polydimethylsiloxane, polystyrene butadiene, polyvinylidene fluoride, Nylon, poly(paraphenylene terephthalamide), and poly(metaphenylene terephthalamide).

The terminal groups of the polymer can either directly participate in polymerization (examples include Formulations #1, 2, 4, and 5) or can be photolabile protecting groups that when cleaved with light, expose a new polymer terminus that then participates in polymerization (for example, Formulation #3). Examples of groups that directly participate in polymerization include: acrylate, methacrylate, allyl, allyl ether, vinyl, vinyl ether, styryl, vinyl arene, thiol, thioketone, and thioester. Examples of photolabile protecting groups include: 2-nitrobenzyl bromide; 2,4-dinitrobenzyl; 4,5-dimethoxy-2-nitrobenzyl; 4-nitro-5-methoxybenzyl; and 2-nitrobenzyl.

Examples of polymer side chains include: polyethylene glycol and polyvinyl alcohol.

Examples of polymer side chain modifiers include: azide and furoxane.

The polymer in the PBX composition will be present in the range of about 2-20%, often about 5-15%, or about 8-12%.

Filler. The filler can include one or more of the following components: (1) energetic; (2) metal powder; (3) ceramic; and/or conductive nanomaterials.

Examples of the one or more fillers or energetics include: nitrotriazolone (NTO); 1,3,5-trinitro-1,3,5-triazinane (RDX); 1,3,5,7-tetranitro-1,3,5,7-tetrazocane (HMX); hexanitrohexaazaisowurtzitane (HNIW/CL-20); ethylene dinitramine (EDNA); aromatic nitramines such as trinitrophenylmethylnitramine (tetryl); nitroglycerine (NG); butanetriol trinitrate (BTTN); pentaerythritol tetranitrate (PETN); 2,4-dinitroanisole (DNAN); trinitrotoluene (TNT); hexanitrostilbene (HNS); triaminotrinitrobenzene (TATB); 1,1-diamino-2,2-dinitroethene (DADNE/FOX-7); inorganic oxidizers such as ammonium nitrate (AN); ammonium perchlorate (AP); ammonium dinitramide (ADN); guanylurea dinitramide (GUDN/FOX-12); energetic alkali metal salts; energetic alkaline earth metal salts; and combinations thereof.

Examples of the metal powder include: aluminum, magnesium, tungsten, nickel, alloys of these metals, and combinations thereof.

Examples of the ceramic include: nanostructured zirconia powder, nanostructured silicon carbide or nitride, B6O, and combinations thereof.

Examples of nanomaterials include: fullerene C60, fullerene C70, graphene, single-wall carbon nanotubes, multiwall carbon nanotubes, graphene oxide, reduced graphene oxide, carboxylic acid-functionalized carbon nanotubes, MoS2 nanosheets, 2-dimensional Ti3C2, 2-dimensional TiC2, 2-dimensional Mo3C2, 2-dimensional MoC2, 2-dimensional Ti3C2, 2-dimensional TiC2, 2-dimensional V3C2, 2-dimensional VC2, 2-dimensional Cr3C2, 2-dimensional CrC2, 2-dimensional Nb3C2, 2-dimensional NbC2.

The filler will be present in the composition in a range of about 80-98%, often about 85-95%, or about 88-92%.

Additives. The additives can include one or more of the following components: (1) crosslinker; (2) chain transfer reagents; (3) burn-rate modifiers; (4) stabilizers; (5) photoinitiator; and/or (6) plasticizer.

Examples of the crosslinker include: 1,3-benzenedithiol; 1,2-ethanedithiol; 1,3-propanedithiol; 1,4-butanedithiol; 1,5-pentanedithiol; dithiothreitol; 1,4-benzenedithiol; 1,3-divinylbenzene; 1,4-divinylbenzene; 1,2-divinylbenzene; 1,3,5-trivinylbenzene; and 2,6-dithionaphthalene; diphenylmethane 4,4'-diisocyanate; toluene 2,4-diisocyanate; isophorone diisocyanate; hexamethylene diisocyanate; 1,4-phenylene diisocyanate; 1,3-phenylene diisocyanate; m-xylylene diisocyanate; tolylene-2,6-diisocyanate.

Examples of the chain transfer reagents include: methyl benzyl trithiocarbonate; dibenzyl trithiocarbonate; dimethyl trithiocarbonate; bis(carboxymethyl)trithiocarbonate; 2-(dodecylthiocarbonothioylthio)-2-methylpropionic acid; 2-(dodecylthiocarbonothioylthio) propionic acid; 2-cyano-2-propyl dodecyl trithiocarbonate; cyanomethyl dodecyl trithiocarbonate; 4-cyano-4-[(dodecylsulfanylthiocarbonyl) sulfanyl]pentanoic acid; 4-cyano-4-[(dodecylsulfanylthiocarbonyl)sulfanyl] pentanol; 2-(2-carboxyethylsulfanylthiocarbonylsulfanyl) propionic acid; Methyl 2-(dodecylthiocarbonothioylthio)-2-methylpropionate; pentaerythritol tetrakis[2-(dodecylthiocarbonothioylthio)-2-methylpropionate]; 3,5-bis(2-dodecylthiocarbonothioylthio-1-oxopropoxy) benzoic acid; 1,1,1-tris[(dodecylthiocarbonothioylthio)-2-methylpropionate]ethane; 4-((((2-carboxyethyl)thio)carbonothioyl)thio)-4-cyanopentanoic acid; benzyl benzodithioate; 2-cyano-2-propyl benzodithioate; 4-cyano-4-(phenylcarbonothioylthio)pentanoic acid; cyanomethyl benzodithioate; 2-cyano-2-propyl 4-cyanobenzodithioate; ethyl 2-(4-methoxyphenylcarbonothioylthio)acetate; ethyl 2-methyl-2-(phenylthiocarbonylthio)propionate; ethyl 2-(phenylcarbonothioylthio)-2-phenylacetate; ethyl 2-(phenylcarbonothioylthio)propionate; 1-(methoxycarbonyl)ethyl benzodithioate; 2-(4-methoxyphenylcarbonothioylthio)ethanoic acid; 2-(phenylcarbonothioylthio)propanoic acid; 2-phenyl-2-propyl benzodithioate; cyanomethyl methyl(phenyl)carbamodithioate; benzyl 1H-pyrrole-1-carbodithioate; cyanomethyl diphenylcarbamodithioate; cyanomethyl methyl(4-pyridyl)carbamodithioate; 2-cyanopropan-2-yl N-methyl-N-(pyridin-4-yl)carbamodithioate; and methyl 2-[methyl(4-pyridinyl)carbamothioylthio]propionate.

Examples of burn-rate modifiers include: iron(II) oxide; iron(III) oxide; iron(III) hydroxide; iron(II,III) oxide; ferrocene; copper(I) oxide; copper(II) oxide; copper chromite; copper salicylate; copper stearate; hexamminecopper(II) perchlorate; cerium(IV) ammonium nitrate; cerium(IV) oxide; hexamminecobalt(II) perchlorate; cobaltocene; hexamminezinc(II) perchlorate; bismuth salicylate; and bismuth subsalicylate.

Examples of stabilizers include: N,N'-bis(cyclohexyl) urea; N,N'-diphenylurea; di-tert-butyl resorcinol (DBR); N-ethyl-para-toluenesulfonamide (NETS); diphenylamine (DPA); alkylated DPA (Agerite Stalite); isopropoxy DPA (ISO); dinapthyl phenylenediamine (Agerite White); napthyl phenylamine (Neozone-D); 2-nitrodiphenyl amine (NDPA); 2,4-dinitrophenylamine (DNDPA); N,N'-diphenyl para-phenylenediamine; dinapthyl phenylenediamine; methylaminoanthraquinone; N,N'-diphenylbenzidine; tetraphenylhydrazine; para-nitroaniline; N-methyl-ortho-nitroaniline; N-methyl-para-nitroaniline (NMA); N-ethyl-para-nitroaniline (NENA); N-(2-cyanoethyl)-para-chloroaniline; N-phenacyl-para-chloroaniline; di(tridecyl)thiodipropionate; elemental sulfur; and 2,2'-methylenebis-(4-methyl-6-tert-butylphenol) (AO-2246).

Examples of the photoinitiator include Type I photoinitiators, Type II photoinitiators and co-initiators.

Type I photoinitiators are unimolecular free-radical generators; that is upon the absorption of UV-light a specific bond within the initiator's structure undergoes homolytic cleavage to produce free radicals. Homolytic cleavage is a bonding pair of electron's even scission into to free radical products. Classes of Type I initiators include: benzoin ethers; benzil ketals; α-dialkoxy-acetophenones; α-hydroxy-alkylphenones; α-amino-alkylphenones; benzophenones; acyl-phosphine oxides; iodonium salts; and sulfonium salts.

Specific examples of Type I initiators include: diphenyl (2,4,6-trimethylbenzoyl)phosphine oxide; lithium phenyl-2,4,6-trimethylbenzoylphosphinate; phenylbis(2,4,6-trimethylbenzoyl)phosphine oxide; 2-benzyl-2-(dimethylamino)-4'-morpholinobutyrophenone; 4'-tert-butyl-2',6'-dimethylacetophenone; 2-hydroxy-4'-(2-hydroxyethoxy)-2-methylpropiophenone; 4'-ethoxyacetophenone; bis(4-tert-butylphenyl)iodonium perfluoro-1-butanesulfonate; (4-tert-butylphenyl)diphenylsulfonium triflate; diphenyliodonium hexafluorophosphate; triphenylsulfonium triflate; 4-(dimethylamino)benzophenone; 4,4'-dihydroxybenzophenone; 4-benzoylbiphenyl; 4,4'-bis(diethylamino)benzophenone; 4,4'-dimethylbenzil; benzoin ethyl ether; 4,4'-dimethoxybenzoin; and 2,2-dimethoxy-2-phenylacetophenone.

Type II photoinitiators require a co-initiator, usually an alcohol or amine, functional groups that can readily have hydrogens abstracted, in addition to the photoinitiator. The absorption of UV light by a Type-II photoinitiator causes an excited electron state in the photoinitiator that will abstract a hydrogen from the co-initiator, and in the process, splitting a bonding pair of electrons. Classes of Type II initiators include: benzophenones and thioxanthones.

Specific examples of Type II initiators include: 9,10-phenanthrenequinone; camphorquinone; 2-tert-butylanthraquinone; 2-chlorothioxanthen-9-one; and 10-methylphenothiazine.

Classes of co-initiators include: primary amines; secondary amines, and tertiary amines.

Specific examples of co-initiators include: triethylamine; diethanolamine; triethanolamine; TREN; butylamine; ethylene diamine; and dimethyl ethylene diamine.

Plasticizers can include both energetic and inert plasticizers. Examples include: dioctyl adipate (DOA); isodecyl pelargonate (IDP); N-butylnitratoethylnitramine (butyl-NENA); nitroglycerine; butanetriol trinitrate (BTTN); dinitrotoluene (DNT); trimethylolethane trinitrate (TMETN); diethylene glycol dinitrate (DEGDN); triethylene glycol dinitrate (TEGDN); bis(2,2-dinitropropyl) formal (BDNPF); bis(2,2-dinitropropyl)acetal (BDNPA); and 2,2,2-trinitroethyl 2-nitroxyethyl ether (TNEN); TA (Triacetin); DEP (diethylphathalate); and DBP (dibutylphathalate); trimethylol ethane trinitrate; triethylene glycol dinitrate; ethylene glycol dinitrate; 1,2,4-butanetriol trinitrate; nitroglycerine; bis(2,2,-dinitropropyl)acetal; bis(2,2,-dinitropropyl)formal; glycidyl azide; ethylene glycol bis(azidoacetate); diethylene glycol bis(azidoacetate); trimethylol nitromethane tris(azidoacetate); pentaerythritol tetrakis(azidoacetate); 2,4-dinitroethylbenzene; 2,4,6-trinitroethylbenzene; methyl nitratoethylnitramine; ethyl nitratoethylnitramine; propyl nitratoethylnitramine; butyl nitratoethylnitramine; pentyl nitratoethylnitramine; isopropyl nitratoethylnitramine; 1,5-diazido-3-nitrazapentane; dinitroxy ethyl nitramine; dioctyl phthalate; diisononyl phthalate; dioctyl adipate; diisononyl adipate; bis(2-ethylhexyl) phthalate; diisodecyl phthalate; bis(2-ethylhexyl) adipate; bis(2-ethylhexyl) terephthalate; dioctyl terephthalate; and 2-nitrophenyl octyl ether.

The additives will be present in the composition in amounts less than 5%, often less than 2%, most commonly around 1%.

Figure 3:
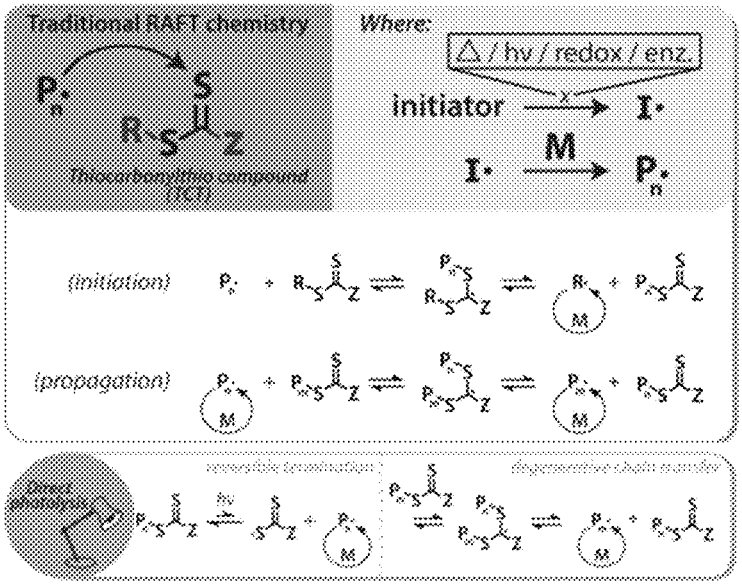
FIG. 3 is a chart that shows the following: Top: reversible addition-fragmentation chain transfer (RAFT) radical polymerization chemistry has become an increasingly popular means of producing controlled synthetic polymers. Bottom: Direct photolysis of the C—S bond can initiate radical polymerization without the need for exogenous photoinitiators. This is expected to reduce undesired side effects in energetic formulations and supports "living polymer" processes.
Figure 4:
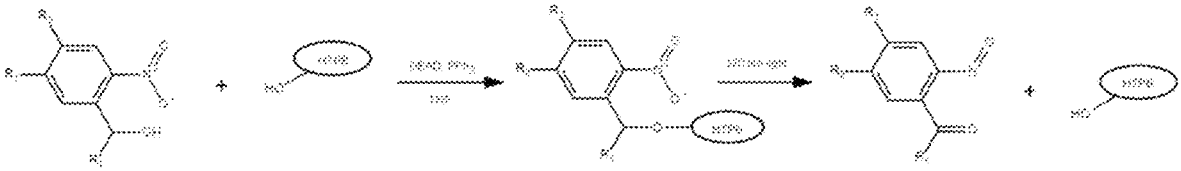
FIG. 4 is a diagram that shows the protection of one of the terminal hydroxyl moieties of HTPB to generate an ortho-nitrobenzyl ether will be accomplished by a high-yield transformation from the corresponding ortho-nitrobenzyl alcohol. Subsequent illumination with light of an appropriate wavelength leads to regeneration of the hydroxyl group. Because of its wide availability and generally superior performance, the inventors used R1=H, R2=R3=OMe (6-nitroveratryl alcohol).

Shape Forming. A JR2200N series robot from Janome with JR C-Points software was used to dispense the formulations onto glass slides. The software was programmed to dispense each layer in three concentric circles. Starting with the first layer, the outer circle was dispensed as two separate arcs, the tip stepped inside the outer circle, the middle layer was dispensed in two separate arcs, the tip stepped inside the middle circle, and the inner circle was dispensed in two separate arcs. Each consecutive layer was then dispensed in reverse order from the previous layer; the second layer started with the inner circle, the third layer started with the outer circle, etc. The final printing parameters were set at 100% auger speed, 25 psi, 2.8 mm/s robot line speed, and 1.2 mm step between layers while using a dispensing tip with an inside diameter of 1.54 mm (olive tip). The resulting print was a small cylindrical shape consisting of twenty uniformly dispensed layers. Prints using Formulations 1 and 4 are shown in FIGS. 2 and 3, respectively. When the dispensing pressure was too high and/or the robot line speed was too slow, too much material was dispensed over each programmed geometry (FIG. 4). When the robot line speed was too fast, the dispensed material was being pulled and not allowed to adhere properly to the previous layer. After printing, the material was placed into the provided aluminum foil lined Styrofoam container equipped with a UV light for 90 minutes to fully cure. No initial cure was conducted on this material.

Figure 17:
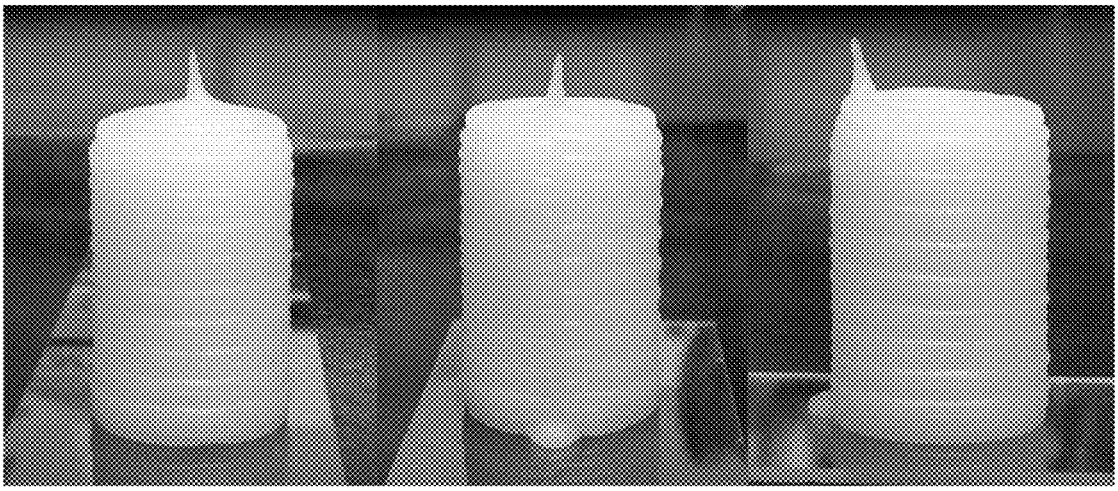
FIG. 17 shows twenty uniform layers of UV cure formulation (Chemistry 1) printed in a cylindrical shape on a glass slide (100% auger speed, 25 psi, 2.8 mm/s robot line speed, olive tip)
Figure 18:
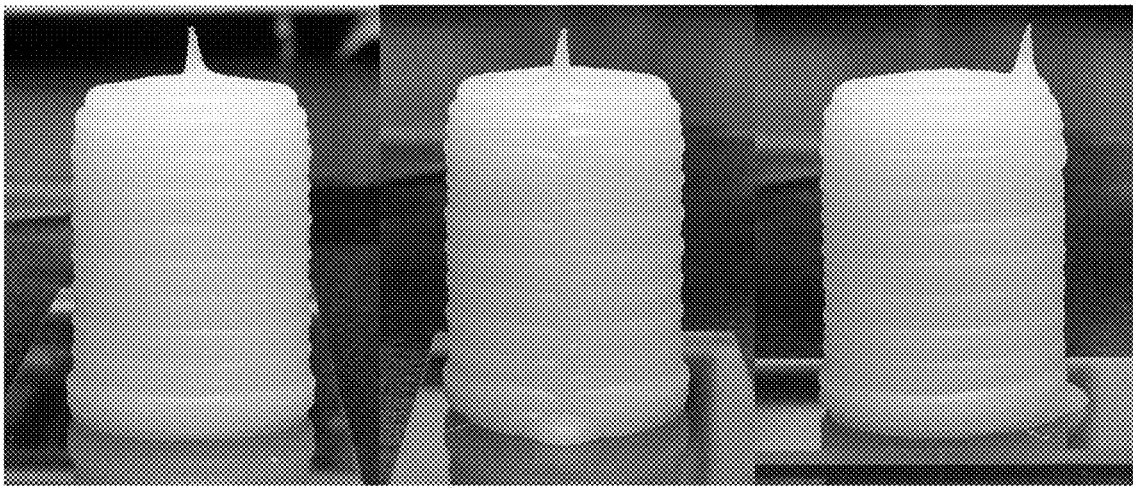
FIG. 18 shows twenty uniform layers of UV cure formulation (Chemistry 4) printed in a cylindrical shape on a glass slide (100% auger speed, 25 psi, 2.8 mm/s robot line speed, olive tip)
Figure 19:
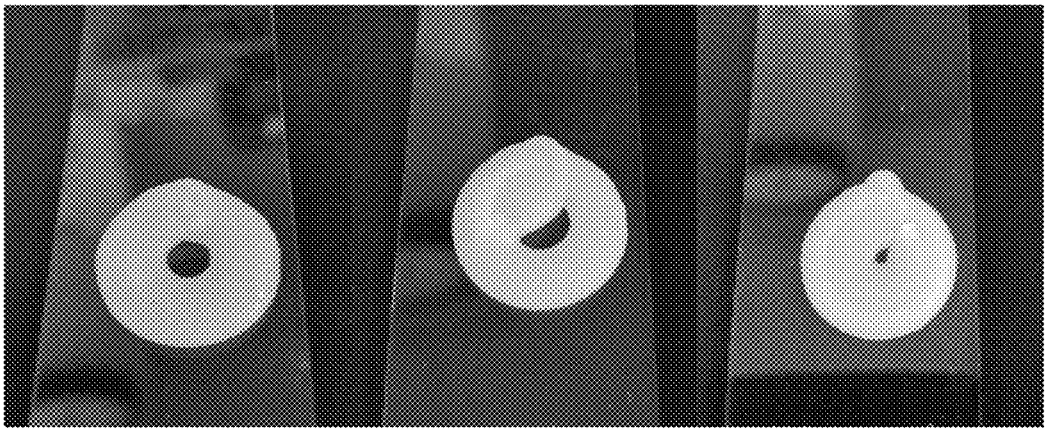
FIG. 19 shows three different prints (Chemistry 4) using 100% auger speed and a 1.54 mm inside diameter tip but a combination of pressure that was too high and/or a robot line speed that was too slow. The Left image used 30 psi and 1 mm/s, the middle image used 25 psi and 1 mm/s, and the right image used 25 psi and 1.5 mm/s.

FIG. 17 shows twenty uniform layers of UV cure formulation (Formulation 1) printed in a cylindrical shape on a glass slide (100% auger speed, 25 psi, 2.8 mm/s robot line speed, olive tip). FIG. 18 shows twenty uniform layers of UV cure formulation (Formulation 4) printed in a cylindrical shape on a glass slide (100% auger speed, 25 psi, 2.8 mm/s robot line speed, olive tip). FIG. 19 shows three different prints (Formulation 4) using 100% auger speed and a 1.54 mm inside diameter tip but a combination of pressure that was too high and/or a robot line speed that was too slow. The Left image used 30 psi and 1 mm/s, the middle image used 25 psi and 1 mm/s, and the right image used 25 psi and 1.5 mm/s.

Figure 20:
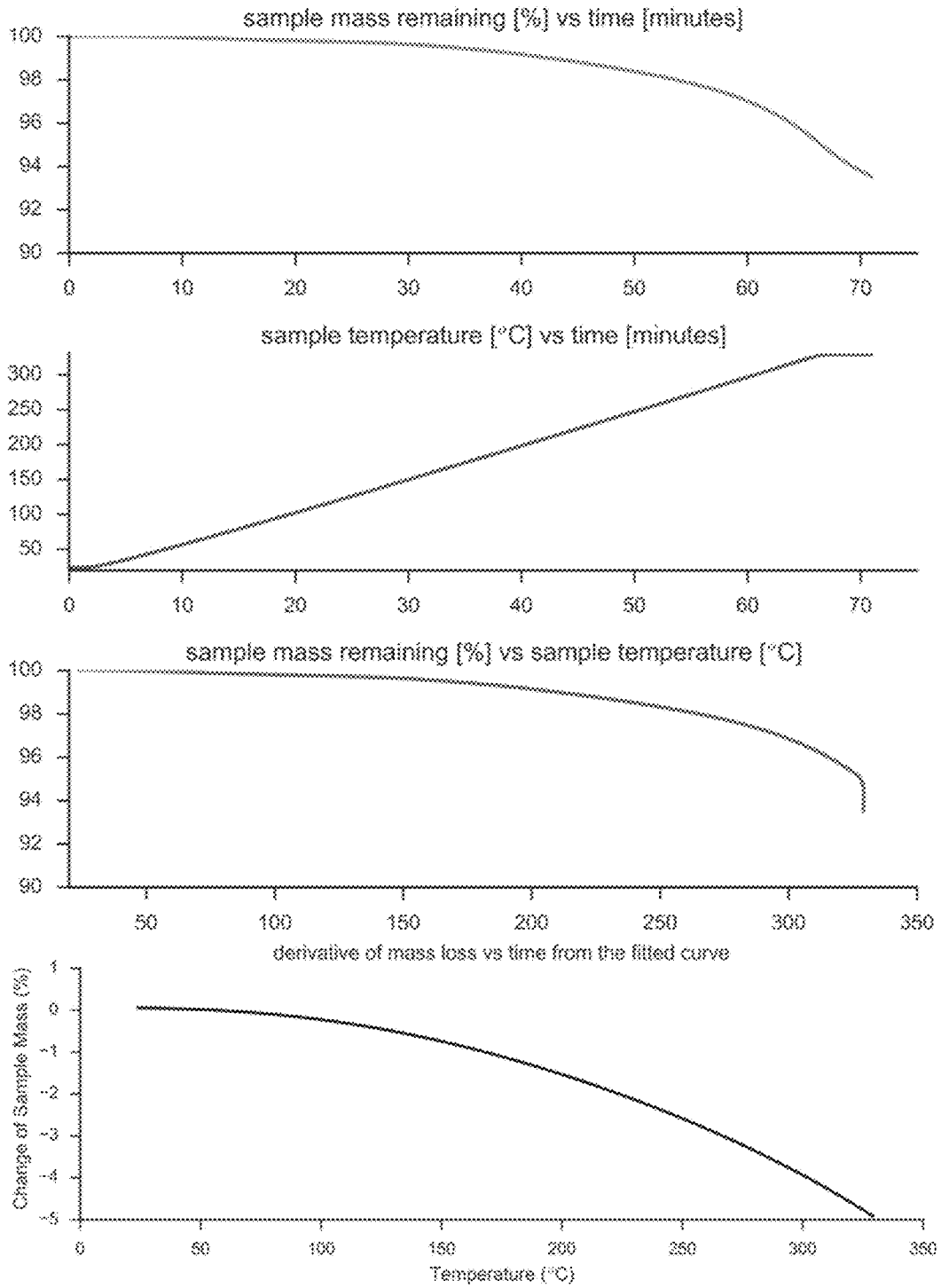
FIG. 20 includes four plots that show the thermal degradation of the cured polymer at approximately 325° C. Below that temperature there is no significant mass loss, and no discernable features which would indicate the release of a solvent or a conformation change of the crosslinked polymer network.

Curing Methods. After curing, the neat ATPB polymer is a clear, somewhat elastic, hydrophobic solid. The inventors used a small sample of cured polymer to perform thermosgravimetric analysis (TGA) with a Netzsch TG209 Libra instrument. The inventors performed heating from ambient to 325° C. at 10° C./minute. As shown FIG. 20 the total mass loss was very low across the range. At the upper end of the temperature range the inventors observe degradation of the polymer, but little to no loss of volatiles and no other observed features in the mass loss curve or its first derivative.

Generally speaking, in terms of product properties, laser initiated reactions are indistinguishable from their conventionally initiated counterparts. Because the laser initiated process follows the same kinetic pathway as conventional systems, the overall rate is limited by reaction kinetics. Therefore, once saturation is achieved at an intensity of approximately 100 mW cm-2, a highly consistent cure profile is obtained for photoinitiated polymerizations, regardless of inconsistencies in pulse time or intensity. The 'light-box' ovens constructed for this effort only achieve 30 mW cm-2, and laser sources only produce 5 mW cm-2, and so the inventors do not necessarily achieve instantaneous saturation. Heating occurs as a result of this process; however, if short pulse times are employed or the overall power delivered is lowered, the temperature rise due to light absorption is negligible compared to the exotherm of the subsequent polymerization or crosslinking processes. As a result, illumination from sources spanning 6 orders of magnitude in intensity has been observed to produce similar polymerization profiles. The greatest benefit of laser induction, then, is the deeper penetration obtained at high intensities. The deeper penetration allows enhanced interlayer adhesion in the printed products by initiating polymerization to a depth that exceeds the printed layer height causing cross-linking across printed layers.

A 5 mW 405 nm laser was positioned on a tracking stage. The stage allowed for several configurations of beam size to cover the full samples for various periods of time, thus controlling the total dose. Depending on the sample size, the laser spot can be varied to including spatial filters and ND filters if necessary (not shown). Depending on the required dose, the sample stage is moved directly over each successive sample for the necessary exposure to test curing.

The system is compact and staged so that it can be mounted adjacent to the printer's extruder. This will allow for curing the previous sample while the current sample is being produced. For this to be achieved, exposure intensity must be appropriate for the printing time in order to receive the proper dose for curing.

The UV LED oven can be a 1200 in3 (12"×10"×10") Styrofoam cooler with a Chanzon 100 W LED Chip mounted on the top center lid. The LED is liquid cooled with an external radiator with forced air flow. The maximum power at the center is 30 mW, falling about 60% at the edges of the floor. The power distribution quickly falls off for measurements normal to the sides, measuring only within 3.5-4 mW. This suggests more can be done to increase the uniformity of the power by maximizing reflections in the cavity.

To fully enable the utilization of energetic formulations in 3D printing, polymer binders in the mixture must have the ability to cure, at least partially, during the printing process in order to hold form and provide structural integrity to the printed part. Without the ability to hold form the print would lose shape and collapse in on itself and turn into a pile of extruded formulation. Photo-curing of the energetic formulations has shown to be one of the best methods to provide the immediate curing of the formulation during the printed process as well as after the part has been fully printed. However, many of the materials utilized in energetic formulations (fuels, catalysts, and some oxidizers) have the potential to partially disrupt the photo-curing of the energetic formulations, through light absorption and/or scattering.

Specifically, it was seen that sagging of printed parts utilizing known energetic mixtures is a significant problem for the successful 3D printing of any energetic formulation. It has been seen that highly viscous mixtures (≥80% solids loading) are capable of maintaining shape for up to 4-5 full layers of a printed form. However, after this height, the sagging of the printed part begins to become noticeable. This sagging will continue to cascade as the printing of the part progresses, to the point where the 3D printer will be extruding/printing in mid-air away from the part to be printed. The significance of the sagging is dependent upon the composition, temperature, and curing mechanisms for the energetic formulations. However, sagging will always occur without some form of fast curing to provide strength and stability to the printed part.

To overcome this issue, formulations will require a multi-cure component in order to provide initial strength to the printed part as well as full cure after the form has been completely printed. This feature will enable the printed form to be partially cured during the printing process, providing structuring integrity, which will enable it to hold form until it can be fully cured. The multi-cure process will typically utilize the benefits of photo-curing along with a secondary curing process typically accelerated using thermal stimulation.

It was seen that utilizing photocuring of the energetic formulations enables the 3D printing to progress beyond 4-5 layers without observing significant sagging of the printed parts. However, it has been demonstrated that this curing needs to be a partial curing and not a full curing of the printed lines/layers of the form. If full curing of the printed lines/layers occurs during the printing process strength and stability can be achieved, however the lines/layers of the printed material are not able to fully coalesce together and create a single form. This lack of adhesion between printed lines/layers creates instability in the printed forms. Embodiments of the present invention use a partial curing process, where the layers of the printed form are exposed to short durations of photocuring light (UV light) to provide enough curing to give stability and strength to the printed form but not enough to fully cure the print and allow for printed lines/layers to fully coalesce together. Typical partial photocuring is accomplished using ~5 second exposure of a 5 W LED at ~6 inches distance. Best results were seen when partial curing was completed at the end of each layer print.

Figure 21A:
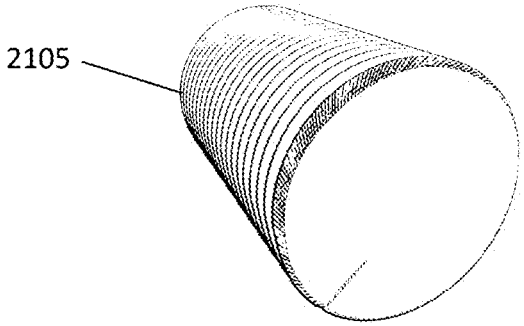
FIGS. 21A, 21B, and 21C show controllable print forms 2105, a solid cylinder; 2110, a hollow cylinder; and 2115, a "dogbone," respectively. Form 2115 demonstrates an uncured portion 2116 and a cured portion 2117.
Figure 21B:
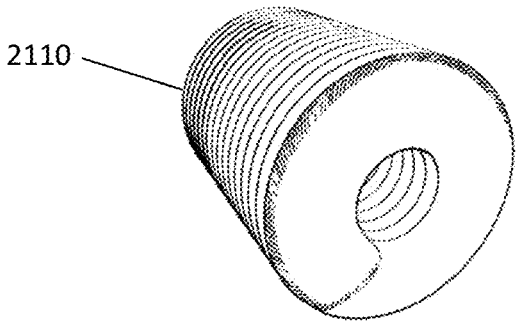
Figure 21C:
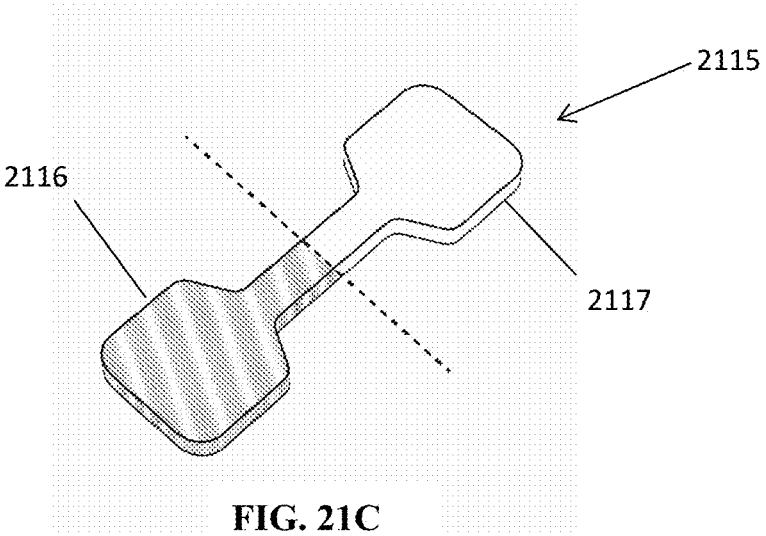

FIGS. 21A, 21B, and 21C show controllable print forms 2105, a solid cylinder; 2110, a hollow cylinder; and 2115, a "dogbone," respectively. Form 2115 demonstrates an uncured portion 2116 and a cured portion 2117.

Figure 22A:
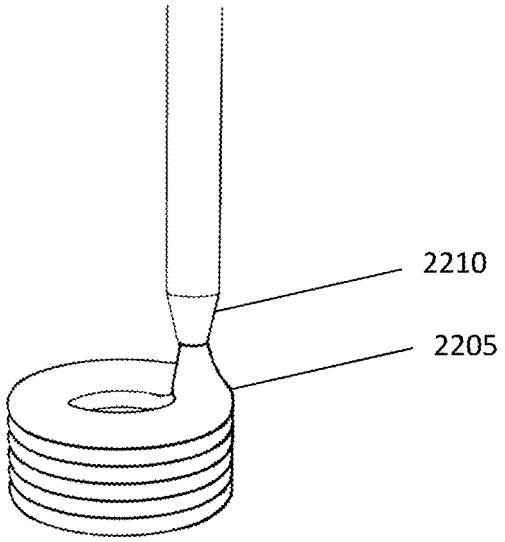
FIGS. 22A and 22B shows extrusion of the printed part 2205 from a tip 2210 before sagging is noticeable and after sagging is noticeable and the printed part 2205 has separated from the tip 2210, respectively.
Figure 22B:
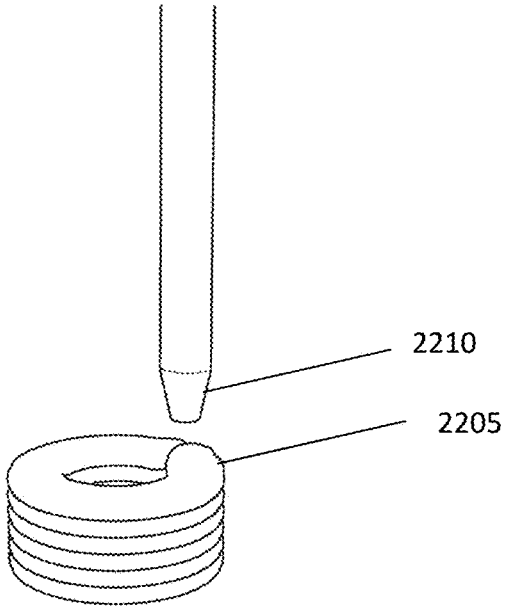

FIGS. 22A and 22B shows extrusion of the printed part 2205 from a tip 2210 before sagging is noticeable and after sagging is noticeable and the printed part 2205 has separated from the tip 2210, respectively.

Figure 23:
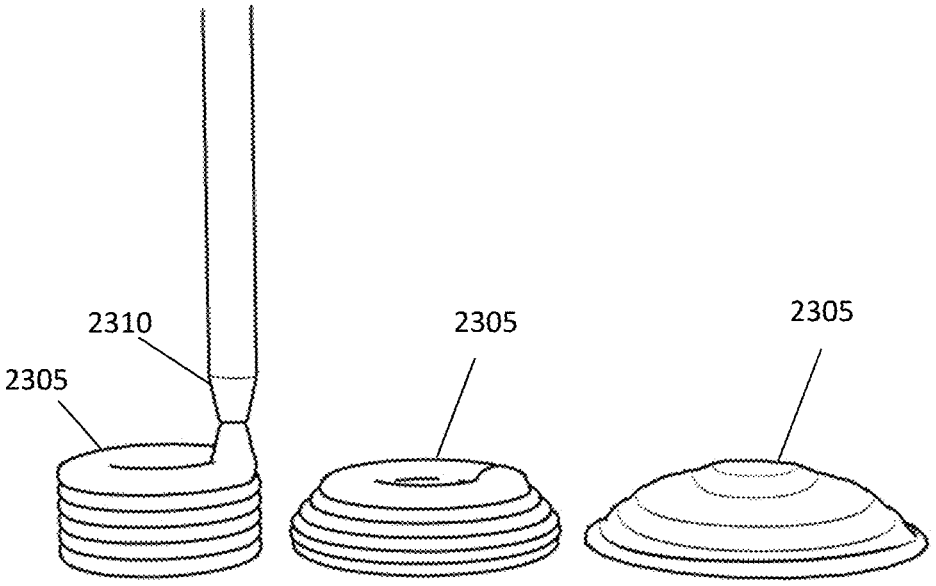
FIG. 23 shows successive views of the progressive sagging of a printed part that is not light-cured, consistent with examples B, D, and K of Table 4.

FIG. 23 shows successive views of the progressive sagging of a printed part 2305 that is not light-cured, consistent with examples B, D, and K of Table 4, and a tip 2310.

Figure 24:
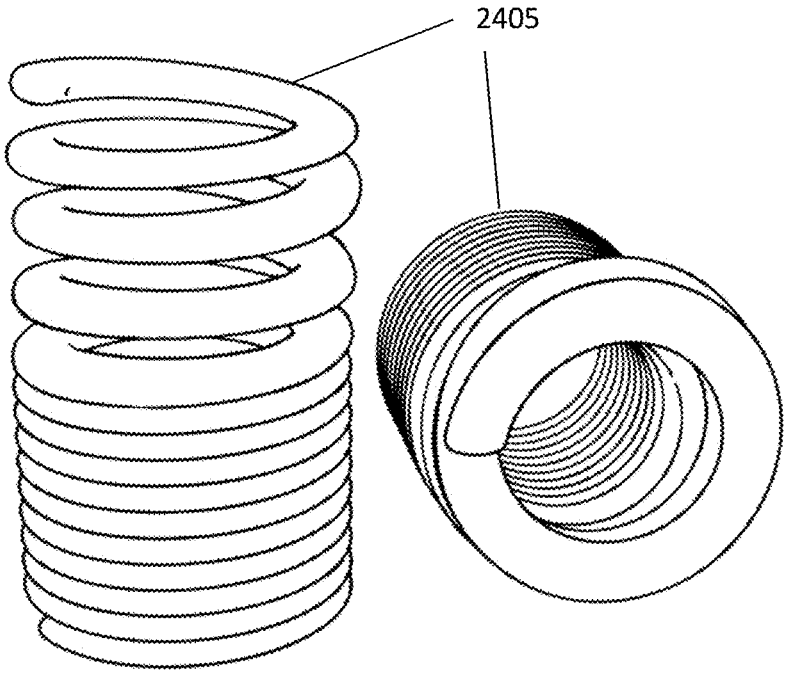
FIG. 24 shows two views of a printed part unravelling after printing due to being fully cured as it was extruded during the printing process, consistent with examples F and G of Table 4.

FIG. 24 shows two views of a printed part 2405 unravelling after printing due to being fully cured as it was extruded during the printing process, consistent with examples F and G of Table 4.

The following formulations were developed to generate a polymer-bonded explosive formulation capable of partially photocuring rapidly under light with a secondary thermal curing mechanism completing the full cure of the formulation. This formulation will retain many of the desirable physical characteristics of conventionally prepared polymer-bonded explosive compositions and will be fully capable of incorporating various concentrations of oxidizers, metal fuels, catalysts, as well as other unique additives.

Formulation 6. Combination of photocurable ATPB and thermally curable HTPB

The steps to generate Formulation 1 include:

1. Chemically convert HTPB to ATPB
2. Mix ATPB, HTPB, Energetic, Photoinitiator, and cyanate-based curing agents
3. Photopolymerize the mixture with 405 nm light
4. Thermally cure the mixture at 70° C.

1. Chemically convert HTPB to ATPB—Identical to the method described previously in Formulation 1. Briefly, the reaction to convert HTPB to ATPB begins with hydroxyl terminated polybutadiene (R-45M, 50 g, 0.178 mol) and triethylamine (1.7 g, 0.0178 mol) being mixed in anhydrous methylene chloride (DCM, 200 mL) at 0° C. to which acryloyl chloride (3.48 mL, 0.0384 mol) is added dropwise over a 30-minute period. The reaction mixture is stirred for 4 hours at 0° C. and allowed to reach room temperature over a 24-hour period.
2. Mix ATPB, HTPB, Energetic, Photoinitiator, and cyanate-based curing agents—An example UV cure formulation includes: 20 wt % binder composition (50% ATPB, 50% HTPB) and 80 wt % ammonium perchlorate (47.6 wt %<25 μm fine AP/52.4 wt % 90 μm coarse AP) with a target batch size of 50 grams of total mixture. The ATPB (~5 g) is first measured in a small container for the Thinky planetary centrifugal mixer. Previously prepared Irgacure 819 solution (20 mg/mL in toluene, 0.63 mL) is added to the container containing ATPB. The container is placed in the Thinky mixer at 2000 rpm for one minute, rested for two minutes, and then placed back in the Thinky mixer for one minute at 2000 rpm. Next, the <25 μm fine AP is added to the container with the mixed binder system and placed in the Thinky mixer at 2000 rpm for one minute. After waiting five minutes for the mixture to cool, the 90 μm coarse AP is then added to the container and placed in the Thinky mixer at 2000 rpm for one minute. At this point, temperature may become a concern due to the heat generated during mixing. Measure temperature to ensure it remains <60° C. At this point, ~5 g of HTPB is added to the container along with ~0.3 g toluene diisocyante (can be substituted for or mixed with another cyanate curing agent). The container is placed in the Thinky mixer at 2000 rpm for one minute.
3. Photopolymerize the mixture with 405 nm light—The mixture is initially photopolymerized through exposure to 405 nm light. This exposure cures (or partially cures) the polymer formulation on the surface enabling the formulation to hold a specific form.
4. Thermally cure the mixture at 70° C.—The photocured formulation is then placed into an oven at 70° C. for at least 2 hours (can be up to 3 days if necessary) to fully cure the entire formulation.

Formulation 7. Combination of Photocurable Diacrylate Terminated Alkanes/Alkenes (DATA) and Thermally Curable HTPB 1. Chemically convert hydroxyl terminated alkanes/alkenes into diacrylate terminated alkanes/alkenes (DATA)
2. Mix DATA, HTPB, Energetic, Photoinitiator, and cyanate-based curing agents
3. Photopolymerize the mixture with 405 nm light
4. Thermally cure the mixture at 70° C.

1. Chemically convert Alkanes/Alkenes into DATA—Identical to the method described previously in Formulation 1 for ATPB synthesis but utilizing short chain (less than 10 carbon chain) alkanes and/or alkenes.
2. Mix DATA, HTPB, Energetic, Photoinitiator, and cyanate-based curing agents—An example UV cure formulation includes: 20 wt % binder composition (50% ATPB, 50% HTPB) and 80 wt % ammonium perchlorate (47.6 wt %<25 μm fine AP/52.4 wt % 90 μm coarse AP) with a target batch size of 50 grams of total mixture. The DATA (~5 g) is first measured in a small container for the Thinky planetary centrifugal mixer. Previously prepared Irgacure 819 solution (20-100 mg/mL in toluene, 0.63 mL) is added to the container containing ATPB. The container is placed in the Thinky mixer at 2000 rpm for one minute, rested for two minutes, and then placed back in the Thinky mixer for one minute at 2000 rpm. Next, the <25 μm fine AP is added to the container with the mixed binder system and placed in the Thinky mixer at 2000 rpm for one minute. After waiting five minutes for the mixture to cool, the 90 μm coarse AP is then added to the container and placed in the Thinky mixer at 2000 rpm for one minute. At this point, temperature may become a concern due to the heat generated during mixing. Measure temperature to ensure it remains <60° C. At this point, ~5 g of HTPB is added to the container along with ~0.3 g toluene diisocyante (can be substituted for or mixed with another cyanate curing agent). The container is placed in the Thinky mixer at 2000 rpm for one minute.
3. Photopolymerize the mixture with 405 nm light—The mixture is initially photopolymerized through exposure to 405 nm light. This exposure cures (or partially cures) the polymer formulation on the surface enabling the formulation to hold a specific form.
4. Thermally cure the mixture at 70° C.—The photocured formulation is then placed into an oven at 70° C. for at least 2 hours (can be up to 3 days if necessary) to fully cure the entire formulation.

Formulation 8. Combination of Photocurable ATPU and Thermally Curable Dicyclopentadiene (DCPD)

1. Chemically convert hydroxyl terminated polyurethane (HTPU) into acrylate terminated polyurethante (ATPU)
2. Mix ATPB, DCPD, Energetic, Photoinitiator, and Grubbs catalyst-based curing agents
3. Photopolymerize the mixture with 405 nm light
4. Thermally cure the mixture at 70° C.

1. Chemically convert HTPU to ATPU—Identical to the method described previously in Formulation 1 for ATPB synthesis but utilizing saturated polyurethane groups.
2. Mix ATPU, DCPD, Energetic, Photoinitiator, and Grubbs catalyst-based curing agents—An example UV cure formulation includes: 20 wt % binder composition (50% ATPU, 50% DCPD) and 80 wt % ammonium perchlorate (47.6 wt %<25 μm fine AP/52.4 wt % 90 μm coarse AP) with a target batch size of 50 grams of total mixture. The ATPU (~5 g) is first measured in a small container for the Thinky planetary centrifugal mixer. Previously prepared Irgacure 819 solution (20 mg/mL in toluene, 0.63 mL) is added to the container containing ATPU. The container is placed in the Thinky mixer at 2000 rpm for one minute, rested for two minutes, and then placed back in the Thinky mixer for one minute at 2000 rpm. Next, the <25 μm fine AP is added to the container with the mixed binder system and placed in the Thinky mixer at 2000 rpm for one minute. After waiting five minutes for the mixture to cool, the 90 μm coarse AP is then added to the container and placed in the Thinky mixer at 2000 rpm for one minute. At this point, temperature may become a concern due to the heat generated during mixing. Measure temperature to ensure it remains <60° C. At this point, ~5 g of DCPD is added to the container along with ~0.019 g of Grubbs-based catalyst ($1^{st}$ generation, $2^{d}$ generation, or hybrid Grubbs catalyst can be used). The container is placed in the Thinky mixer at 2000 rpm for one minute.
3. Photopolymerize the mixture with 405 nm light—The mixture is initially photopolymerized through exposure to 405 nm light. This exposure cures (or partially cures) the polymer formulation on the surface enabling the formulation to hold a specific form.
4. Thermally cure the mixture at 70° C.—The photocured formulation is then placed into an oven at 70° C. for at least 2 hours (can be up to 3 days if necessary) to fully cure the entire formulation through ring-opening metathesis polymerization (ROMP).

Formulation 9. Combination of Photocurable Diacrylate Terminated Alkanes/Alkenes (DATA) and Thermally Curable Dicyclopentadiene (DCPD)

1. Chemically convert hydroxyl terminated alkanes/alkenes into diacrylate terminated alkanes/alkenes (DATA)
2. Mix DATA, DCPD, Energetic, Photoinitiator, and cyanate-based curing agents
3. Photopolymerize the mixture with 405 nm light
4. Thermally cure the mixture at 70° C.

Thermally cure the mixture at 70° C.

1. Chemically convert Alkanes/Alkenes into DATA—Identical to the method described previously in Formulation 1 for ATPB synthesis but utilizing short chain (less than 10 carbon chain) alkanes and/or alkenes.
2. Mix DATA, DCPD, Energetic, Photoinitiator, and Grubbs catalyst-based curing agents—An example UV cure formulation includes: 20 wt % binder composition (50% ATPU, 50% DCPD) and 80 wt % ammonium perchlorate (47.6 wt %<25 μm fine AP/52.4 wt % 90 μm coarse AP) with a target batch size of 50 grams of total mixture. The DATA (~5 g) is first measured in a small container for the Thinky planetary centrifugal mixer. Previously prepared Irgacure 819 solution (20 mg/mL in toluene, 0.63 mL) is added to the container containing DATA. The container is placed in the Thinky mixer at 2000 rpm for one minute, rested for two minutes, and then placed back in the Thinky mixer for one minute at 2000 rpm. Next, the <25 μm fine AP is added to the container with the mixed binder system and placed in the Thinky mixer at 2000 rpm for one minute. After waiting five minutes for the mixture to cool, the 90 μm coarse AP is then added to the container and placed in the Thinky mixer at 2000 rpm for one minute. At this point, temperature may become a concern due to the heat generated during mixing. Measure temperature to ensure it remains <60° C. At this point, ~5 g of DCPD is added to the container along with ~0.019 g of Grubbs-based catalyst ($1^{st}$ generation, $2^{d}$ generation, or hybrid Grubbs catalyst can be used). The container is placed in the Thinky mixer at 2000 rpm for one minute.
3. Photopolymerize the mixture with 405 nm light—The mixture is initially photopolymerized through exposure to 405 nm light. This exposure cures (or partially cures)

the polymer formulation on the surface enabling the formulation to hold a specific form.

4. Thermally cure the mixture at 70° C.—The photocured formulation is then placed into an oven at 70° C. for at least 2 hours (can be up to 3 days if necessary) to fully cure the entire formulation through ring-opening metathesis polymerization (ROMP).]

Formulation 10. Combination of Photocurable ATPB and Thermally Curable Glycidyl Azide Polymers (GAP)

1. Chemically convert HTPB to ATPB—Identical to the method described previously in Formulation 1 for ATPB synthesis.
2. Mix ATPB, GAP, Energetic, Photoinitiator, and cyanate-based curing agents
3. Photopolymerize the mixture with 405 nm light
4. Thermally cure the mixture at 70° C.
1. Chemically convert HTPB to ATPB—Identical to the method described previously in Formulation 1 for ATPB synthesis. Briefly, the reaction to convert HTPB to ATPB begins with hydroxyl terminated polybutadiene (R-45M, 50 g, 0.178 mol) and triethylamine (1.7 g, 0.0178 mol) being mixed in anhydrous methylene chloride (DCM, 200 mL) at 0° C. to which acryloyl chloride (3.48 mL, 0.0384 mol) is added dropwise over a 30-minute period. The reaction mixture is stirred for 4 hours at 0° C. and allowed to reach room temperature over a 24-hour period.
2. Mix ATPB, GAP, Energetic, Photoinitiator, and cyanate-based curing agents—An example UV cure formulation includes: 20 wt % binder composition (50% ATPB, 50% HTPB) and 80 wt % ammonium perchlorate (47.6 wt %<25 μm fine AP/52.4 wt % 90 μm coarse AP) with a target batch size of 50 grams of total mixture. The ATPB (~5 g) is first measured in a small container for the Thinky planetary centrifugal mixer. Previously prepared Irgacure 819 solution (20 mg/mL in toluene, 0.63 mL) is added to the container containing ATPB. The container is placed in the Thinky mixer at 2000 rpm for one minute, rested for two minutes, and then placed back in the Thinky mixer for one minute at 2000 rpm. Next, the <25 μm fine AP is added to the container with the mixed binder system and placed in the Thinky mixer at 2000 rpm for one minute. After waiting five minutes for the mixture to cool, the 90 μm coarse AP is then added to the container and placed in the Thinky mixer at 2000 rpm for one minute. At this point, temperature may become a concern due to the heat generated during mixing. Measure temperature to ensure it remains <60° C. At this point, ~5 g of GAP is added to the container along with ~0.3 g toluene diisocyante (can be substituted for or mixed with another cyanate curing agent). The container is placed in the Thinky mixer at 2000 rpm for one minute.
3. Photopolymerize the mixture with 405 nm light—The mixture is initially photopolymerized through exposure to 405 nm light. This exposure cures (or partially cures) the polymer formulation on the surface enabling the formulation to hold a specific form.
4. Thermally cure the mixture at 70° C.—The photocured formulation is then placed into an oven at 70° C. for at least 2 hours (can be up to 3 days if necessary) to fully cure the entire formulation.

Formulation 11. Combination of Photocurable ATPB and Thermally Curable Carboy-Terminated Polybutadiene (CTPB)

1. Chemically convert HTPB to ATPB—Identical to the method described previously in Formulation 1 for ATPB synthesis. Briefly, the reaction to convert HTPB to ATPB begins with hydroxyl terminated polybutadiene (R-45M, 50 g, 0.178 mol) and triethylamine (1.7 g, 0.0178 mol) being mixed in anhydrous methylene chloride (DCM, 200 mL) at 0° C. to which acryloyl chloride (3.48 mL, 0.0384 mol) is added dropwise over a 30-minute period. The reaction mixture is stirred for 4 hours at 0° C. and allowed to reach room temperature over a 24-hour period.
2. Mix ATPB, CTPB, Energetic, Photoinitiator, and cyanate-based curing agents—An example UV cure formulation includes: 20 wt % binder composition (50% ATPB, 50% HTPB) and 80 wt % ammonium perchlorate (47.6 wt %<25 μm fine AP/52.4 wt % 90 μm coarse AP) with a target batch size of 50 grams of total mixture. The ATPB (~5 g) is first measured in a small container for the Thinky planetary centrifugal mixer. Previously prepared Irgacure 819 solution (20 mg/mL in toluene, 0.63 mL) is added to the container containing ATPB. The container is placed in the Thinky mixer at 2000 rpm for one minute, rested for two minutes, and then placed back in the Thinky mixer for one minute at 2000 rpm. Next, the <25 μm fine AP is added to the container with the mixed binder system and placed in the Thinky mixer at 2000 rpm for one minute. After waiting five minutes for the mixture to cool, the 90 m coarse AP is then added to the container and placed in the Thinky mixer at 2000 rpm for one minute. At this point, temperature may become a concern due to the heat generated during mixing. Measure temperature to ensure it remains <60° C. At this point, ~5 g of CTPB is added to the container along with ~0.3 g toluene diisocyante (can be substituted for or mixed with another cyanate curing agent). The container is placed in the Thinky mixer at 2000 rpm for one minute.
3. Photopolymerize the mixture with 405 nm light—The mixture is initially photopolymerized through exposure to 405 nm light. This exposure cures (or partially cures) the polymer formulation on the surface enabling the formulation to hold a specific form.
4. Thermally cure the mixture at 70° C.—The photocured formulation is then placed into an oven at 70° C. for at least 2 hours (can be up to 3 days if necessary) to fully cure the entire formulation.

TABLE 4

Example method embodiments of the present invention with various parameters and results

| Example | Binder (includes ≥80% Solids Loading) | Layers (#) | Applied Light per Layer | Layers w/ Light Curing | Heat during printing | Dimensions Capable | Results - Successful 3D Printed Form |
|---|---|---|---|---|---|---|---|
| A | 20% HTPB/80% PBX | ≤4 | None | None | | Simple | Pass |

TABLE 4-continued

Example method embodiments of the present invention with various parameters and results

| Example | Binder (includes ≥80% Solids Loading) | Layers (#) | Applied Light per Layer | Layers w/ Light Curing | Heat during printing | Dimensions Capable | Results - Successful 3D Printed Form |
|---|---|---|---|---|---|---|---|
| B | HTPB | >4 | None | None | | Simple | Fail |
| C | 20% ATPB/80% PBX | ≤4 | None | None | | Simple | Pass |
| D | ATPB | >4 | None | None | | Simple | Fail |
| E | ATPB | >4 | 5 seconds | 1 | | Simple/ Complex | Pass |
| F | ATPB | >4 | Continuous | 1 | | Simple/ Complex | Fail |
| G | ATPB | >4 | 20 seconds | 1 | | Simple/ Complex | Fail |
| H | 10% ATPB 10% HTPB 80% PBX | ≤4 | None | None | | Simple | Pass |
| I | ATPB/ HTPB | >4 | 5 seconds | 1 | | Simple/ Complex | Pass |
| J | TCPB | ≤4 | None | None | X | Simple | Pass |
| K | TCPB | >4 | None | None | X | Simple | Fail |
| L | ATPB/ TCPB | ≤4 | None | None | X | Simple | Pass |
| M | ATPB/ TCPB | >4 | 5 seconds | 1 | X | Simple/ Complex | Pass |

Comments on Table 4:

Example A: 3D print Passes because the print is of simple dimension and is at or below 4 Layers.

Example B: 3D print Fails because the print is over 4 Layers and will begin to sag because it has no curing and limited strength and structure.

Example C: 3D print Passes because the print is of simple dimension and is at or below 4 Layers.

Example D: 3D print Fails because the print is over 4 Layers and will begin to sag because it has no curing and limited strength and structure.

Example E: 3D print Passes because the print is of simple or complex dimension and has partial curing giving the part strength and structure eliminating sag.

Example F: 3D print Fails because the print is of simple or complex dimension and the continuous curing during printing prevents the printed layers for coalescing together to provide strength and stability to the part.

Example G: 3D print Fails because the print is of simple or complex dimension and the print has too much curing which prevents the printed layers for coalescing together to provide strength and stability to the part.

Example H: 3D print Passes because the print is of simple dimension and is at or below 4 Layers.

Example I: 3D print Passes because the print is of simple or complex dimension and has partial curing giving the part strength and structure eliminating sag.

Example J: 3D print Passes because the print is of simple dimension and is at or below 4 Layers.

Example K: 3D print Fails because the print is over 4 Layers and will begin to sag because it has no curing and limited strength and structure.

Example L: 3D print Passes because the print is of simple dimension and is at or below 4 Layers.

Example M: 3D print Passes because the print is of simple or complex dimension and has partial curing giving the part strength and structure eliminating sag.

One embodiment of the present invention includes a formulation for additive manufacturing including: a mixture of a pot-stable photo-curable polymer and a thermally curable polymer; one or more fillers; and one or more additives, wherein the formulation cures into a fully cured polymer in six hours or less upon exposure to light and heat. In one aspect of this embodiment, the one or more fillers are selected from at least one of: nitrotriazolone (NTO); 1,3,5-trinitro-1,3,5-triazinane (RDX); 1,3,5,7-tetranitro-1,3,5,7-tetrazocane (HMX); hexanitrohexaazaisowurtzitane (HNIW/CL-20); ethylene dinitramine (EDNA); aromatic nitramines such as trinitrophenylmethylnitramine (tetryl); nitroglycerine (NG); butanetriol trinitrate (BTTN); pentaerythritol tetranitrate (PETN); 2,4-dinitroanisole (DNAN); trinitrotoluene (TNT); hexanitrostilbene (HNS); triaminotrinitrobenzene (TATB); 1,1-diamino-2,2-dinitroethene (DADNE/FOX-7); inorganic oxidizers such as ammonium nitrate (AN); ammonium perchlorate (AP); ammonium dinitramide (ADN); guanylurea dinitramide (GUDN/FOX-12); energetic alkali metal salts; energetic alkaline earth metal salts; or combinations thereof. In another aspect of this embodiment, the polymer has a backbone (linear or branched) that is selected from at least one of: polybutadiene, glycidyl azide polymers (GAP), Dicyclopentadiene (DCPD), poly(butadiene-co-acrylonitrile), poly(azidomethyl ethylene oxide), poly(bis-azidomethyl oxetane), poly(nitratomethyl-methyl oxetane), poly(azidomethyl-methyl oxetane), poly(bis-nitratomethyl oxetane), poly(methylmethacrylate), polyacrylic acid, polystyrene, polytetrafluoroethylene, perfluoropolyether, poly(ethylene glycol), polycarbonate, polyethylene terephthalate, polyurethanes, vinyl polydimethylsiloxane, thiol polydimethylsiloxane, polystyrene butadiene, polyvinylidene fluoride, Nylon, poly(paraphenylene terephthalamide), or poly(metaphenylene terephthalamide). In still another aspect, the polymer has two or more terminal groups of the polymer can either directly participate in polymerization or can be photolabile protecting groups that when cleaved with light, expose a new polymer terminus that then participates in polymerization, selected from at least one of: acrylate, methacrylate, allyl, allyl ether, vinyl, vinyl ether, styryl, vinyl arene, thiol, thioketone, and thioester and the photolabile protecting groups include: 2-nitrobenzyl bromide; 2,4-dinitrobenzyl; 4,5-dimethoxy-2-nitrobenzyl; 4-nitro-5-methoxybenzyl; or 2-nitrobenzyl. In yet another aspect, the polymer has two or more terminal groups of the polymer that can either directly participate in polymerization and/or can be thermally accelerated to do so, and wherein such groups include: hydroxyl, carboxyl, amine, thiol, ester, or ether. In yet another aspect, thermal polymerization (thermosetting) is achieved utilizing at least one of the following polymerization processes: ring-opening metathesis polymerization (ROMP), reversible addition-fragmentation chain-transfer polymerization (RAFT), diisocyanate crosslinking, thermosetting epoxy resins, sulfur vulcanization, thermally activated peroxide crosslinking.

It has also been seen that the high viscosity of the energetic formulations creates problems with effectively extruding the paste-like mixture (>80% solids loading) through small diameter nozzles (0.5-2 mm). It has been seen, and is well known, that these high solids loading formulations shear thicken as the pressure to extrude them is increased. This forces the 3D printing of the energetic formulations (whether piston driven or pneumatically driven extruders were utilized) to be performed at low print speeds (~1 mm/s, cold extrusion) in order to maintain accuracy during the printing process. Attempts to reduce the viscosity, thus enabling higher pressures to be utilized without shear thickening of the formulations, were found to provide minimal gains in the print speeds. For lower viscosity formulations with high solids loading it was observed that phase separation of the liquid binder and solid energetic occurred. The occurrence of phase separation was dependent upon the size and loading of the energetic material as well as the pressures utilized for printing. This created a gradient for the phase separation making it difficult to determine when it began to phase separate. Overall the phase separation drastically hurt the quality and consistency of the 3D printed components.

Embodiments of the present invention include changing the methods used for loading, prepping, and printing with the viscous high solids loading (≥80%) energetic formulations. The biggest problem with extruding these formulations through small diameter nozzles (0.5-2 mm) surrounded the pressure memory of the high solids loading formulation. Once the formulation was extruded at a specific speed/pressure, any further extrusion at a lower speed/pressure would result in jamming of the print nozzle. To combat this it was found that loading and prepping of the formulations in the extrusion system need to be completed at the desired print speeds. Once the extrusion system was fully prepped and loaded with the energetic formulation printing can then be completed. It was found that this process enabled print speeds to be completed at over 10 mm/s (≥10× increase in print speed, cold extrusion) without any significant jamming caused by shear thickening or needing to utilize high temperatures or excessive printing pressures (pneumatic systems). This is important as prints can now be completed in a much faster time frame enabling faster results and enabling better manufacturing of printed parts.

In one embodiment, the present invention comprises, consists essentially of, or consists of a formulation for additive manufacturing comprising: a pot-stable photo-curable polymer; one or more fillers; and one or more additives, wherein the formulation cures into a polymer in six hours or less upon exposure to light.

In another embodiment, the present invention comprises, consists essentially of, or consists of a method of additive manufacturing of a formulation comprising: preparing a formulation comprising: a pot-stable photo-curable polymer; one or more fillers; and one or more additives; exposing the formulation to a photoinitiator, wherein the formulation substantially cures the polymer in 6 hours or less.

In another embodiment, the present invention comprises, consists essentially of, or consists of an additive materials system comprising: a stage; and a printer in fluid communication with at least one source of a formulation stored in a container that is light-impervious comprising: a pot-stable photo-curable polymer; one or more fillers; and one or more additives; and a source of light for exposing the formulation, wherein the light is provided in an amount sufficient to substantially cure the formulation in 6 hours or less.

In another embodiment, the present invention comprises, consists essentially of, or consists of a photocurable polymer-bonded explosive made by a method comprising: preparing a formulation comprising: a pot-stable photo-curable polymer; one or more fillers; and one or more additives; and printing the formulation additively on a surface; and exposing the formulation to light in an amount that substantially cures the polymer in 6 hours or less.

In another embodiment, the present invention comprises, consists essentially of, or consists of a moldless method of additive manufacturing of a polymer-bonded explosive comprising: preparing a formulation comprising: a pot-stable photo-curable polymer; one or more fillers; and one or more additives; and exposing the formulation to light in an amount that substantially cures the polymer in 6 hours or less.

In another embodiment, the present invention comprises, consists essentially of, or consists of a formulation for additive manufacturing comprising: a mixture of a pot-stable photo-curable polymer and a thermally curable polymer; one or more fillers; and one or more additives, wherein the formulation cures into a fully cured polymer in six hours or less upon exposure to light and heat.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), property(ies), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skill in the art recognize the modified feature as still having the required characteristics and capabilities of the unmodified feature. In general, but subject to the preceding discussion, a numerical value herein that is modified by a word of approximation such as "about" may vary from the stated value by at least 1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

To aid the Patent Office, and any readers of any patent issued on this application in interpreting the claims appended hereto, applicants wish to note that they do not intend any of the appended claims to invoke paragraph 6 of 35 U.S.C. § 112, U.S.C. § 112 paragraph (f), or equivalent, as it exists on the date of filing hereof unless the words "means for" or "step for" are explicitly used in the particular claim.

For each of the claims, each dependent claim can depend both from the independent claim and from each of the prior dependent claims for each and every claim so long as the prior claim provides a proper antecedent basis for a claim term or element.

What is claimed is:

1. A photocurable polymer-bonded explosive made by a method comprising:

preparing a formulation comprising:

a polymer, wherein a chemical protecting group is added to the polymer to prevent curing in the presence of one or more isocyanates except when exposed to visible light;

one or more fillers; and one or more additives;

printing the formulation additively on a surface;

exposing each layer of the printed formulation to light in an amount that partially cures the polymer; and exposing the printed formulation to heat in an amount that substantially cures the polymer.

2. The formulation of claim 1, wherein the polymer has two or more terminal groups of the polymer that can either directly participate in polymerization or can be photolabile protecting groups that when cleaved with light, expose a new polymer terminus that then participates in polymerization, selected from at least one of: acrylate, methacrylate, allyl, allyl ether, vinyl, vinyl ether, styryl, vinyl arene, thiol, thioketone, and thioester and the photolabile protecting groups comprise: 2-nitrobenzyl bromide; 2,4-dinitrobenzyl; 4,5-dimethoxy-2-nitrobenzyl; 4-nitro-5-methoxybenzyl; and 2-nitrobenzyl.

3. The formulation of claim 1, wherein the one or more fillers are selected from at least one of: nitrotriazolone (NTO); 1,3,5-trinitro-1,3,5-triazinane (RDX); 1,3,5,7-tetranitro-1,3,5,7-tetrazocane (HMX); hexanitrohexaazaisowurtzitane (HNIW/CL-20); ethylene dinitramine (EDNA); aromatic nitramines such as trinitrophenylmethylnitramine (tetryl); nitroglycerine (NG); butanetriol trinitrate (BTTN); pentaerythritol tetranitrate (PETN); 2,4-dinitroanisole (DNAN); trinitrotoluene (TNT); hexanitrostilbene (HNS); triaminotrinitrobenzene (TATB); 1,1-diamino-2,2-dinitroethene (DADNE/FOX-7); inorganic oxidizers such as ammonium nitrate (AN); ammonium perchlorate (AP); ammonium dinitramide (ADN); guanylurea dinitramide (GUDN/FOX-12); energetic alkali metal salts; energetic alkaline earth metal salts; and combinations thereof.

4. The formulation of claim 1, wherein the polymer has a backbone (linear or branched) that is selected from at least one of: polybutadiene, poly(butadiene-co-acrylonitrile), poly(azidomethyl ethylene oxide), poly(bis-azidomethyl oxetane), poly(nitratomethyl-methyl oxetane), poly(azidomethyl-methyl oxetane), poly(bis-nitratomethyl oxetane), poly(methylmethacrylate), polyacrylic acid, polystyrene, polytetrafluoroethylene, perfluoropolyether, poly(ethylene glycol), polycarbonate, polyethylene terephthalate, polyurethanes, vinyl polydimethylsiloxane, thiol polydimethylsiloxane, polystyrene butadiene, polyvinylidene fluoride, Nylon, poly(paraphenylene terephthalamide), and poly (metaphenylene terephthalamide).

5. The formulation of claim 1, wherein a polymer side chain of the polymer is selected from at least one of: polyethylene glycol and polyvinyl alcohol.

6. The formulation of claim 1, wherein a polymer side chain modifier of the polymer is selected from at least one of: azide and furoxane.

7. The formulation of claim 1, wherein the one or more fillers is present in the range of about 2-20%, often about 5-15%, or about 8-12% weight-to-weight.

8. The formulation of claim 1, wherein the one or more fillers comprise one or more of the following components: (1) a metal powder; (2) a ceramic; or a conductive material.

9. The formulation of claim 8, wherein the metal powder is selected from at least one of: aluminum, magnesium, tungsten, nickel, alloys of these metals, and combinations thereof.

10. The formulation of claim 1, wherein the ceramic is selected from at least one of: nanostructured zirconia powder, nanostructured silicon carbide or nitride, $B_6O$, and combinations thereof.

11. The formulation of claim 8, wherein the conductive material is selected from at least one of: fullerene C60, fullerene C70, graphene, single-wall carbon nanotubes, multiwall carbon nanotubes, graphene oxide, reduced graphene oxide, carboxylic acid-functionalized carbon nanotubes, $MoS_2$ nanosheets, 2-dimensional $Ti_3C_2$, 2-dimensional $TiC_2$, 2-dimensional $Mo_3C_2$, 2-dimensional $MoC_2$, 2-dimensional $Ti_3C_2$, 2-dimensional $TiC_2$, 2-dimensional $V_3C_2$, 2-dimensional $VC_2$, 2-dimensional $Cr_3C_2$, 2-dimensional $CrC_2$, 2-dimensional $Nb_3C_2$, 2-dimensional $NbC_2$.

12. The formulation of claim 1, wherein the one or more fillers is present in the formulation in a range of about 80-98%, often about 85-95%, or about 88-92% weight to weight.

13. The formulation of claim 1, further comprising one or more additives selected from at least one of: (1) one or more crosslinkers; (2) one or more chain transfer reagents; (3) one or more burn-rate modifiers; (4) one or more stabilizers; (5) one or more photoinitiators; or (6) one or more plasticizers.

14. The formulation of claim 13, wherein the one or more crosslinkers are selected from at least one of: 1,3-benzenedithiol; 1,2-ethanedithiol; 1,3-propanedithiol; 1,4-butanedithiol; 1,5-pentanedithiol; dithiothreitol; 1,4-benzenedithiol; 1,3-divinylbenzene; 1,4-divinylbenzene; 1,2-divinylbenzene; 1,3,5-trivinylbenzene; and 2,6-dithionaphthalene; diphenylmethane 4,4'-diisocyanate; toluene 2,4-diisocyanate; isophorone diisocyanate; hexamethylene diisocyanate; 1,4-phenylene diisocyanate; 1,3-phenylene diisocyanate; m-xylylene diisocyanate; tolylene-2,6-diisocyanate.

15. The formulation of claim 13, wherein the one or more chain transfer reagents are selected from at least one of: methyl benzyl trithiocarbonate; dibenzyl trithiocarbonate; dimethyl trithiocarbonate; bis(carboxymethyl)trithiocarbonate; 2-(dodecylthiocarbonothioylthio)-2-methylpropionic acid; 2-(dodecylthiocarbonothioylthio) propionic acid; 2-cyano-2-propyl dodecyl trithiocarbonate; cyanomethyl dodecyl trithiocarbonate; 4-cyano-4-[(dodecylsulfanylthiocarbonyl)sulfanyl]pentanoic acid; 4-cyano-4-[(dodecylsulfanylthiocarbonyl)sulfanyl] pentanol; 2-(2-carboxyethylsulfanylthiocarbonylsulfanyl) propionic acid; Methyl 2-(dodecylthiocarbonothioylthio)-2-methylpropionate; pentaerythritol tetrakis[2-(dodecylthiocarbonothioylthio)-2-methylpropionate]; 3,5-bis(2-dodecylthiocarbonothioylthio-1-oxopropoxy) benzoic acid; 1,1,1-tris[(dodecylthiocarbonothioylthio)-2-methylpropionate]ethane; 4-((((2-carboxyethyl)thio)carbonothioyl)thio)-4-cyanopentanoic acid; benzyl benzodithioate; 2-cyano-2-propyl benzodithioate; 4-cyano-4-(phenylcarbonothioylthio)pentanoic acid; cyanomethyl benzodithioate; 2-cyano-2-propyl 4-cyanobenzodithioate; ethyl 2-(4-methoxyphenylcarbonothioylthio)acetate; ethyl 2-methyl-2-(phenylthiocarbonylthio)propionate; ethyl 2-(phenylcarbonothioylthio)-2-phenylacetate; ethyl 2-(phenylcarbonothioylthio)propionate; 1-(methoxycarbonyl)ethyl benzodithioate; 2-(4-methoxyphenylcarbonothioylthio)ethanoic acid; 2-(phenylcarbonothioylthio)propanoic acid; 2-phenyl-2-propyl benzodithioate; cyanomethyl methyl(phenyl)carbamodithioate; benzyl 1H-pyrrole-1-carbodithioate; cyanomethyl diphenylcarbamodithioate; cyanomethyl methyl(4-pyridyl)carbamodithioate; 2-cyanopropan-2-yl N-methyl-N-(pyridin-4-yl)carbamodithioate; or methyl 2-[methyl(4-pyridinyl)carbamothioylthio]propionate.

16. The formulation of claim 13, wherein the one or more burn-rate modifiers are selected from at least one of: iron(II) oxide; iron(III) oxide; iron(III) hydroxide; iron(II,III) oxide; ferrocene; copper(I) oxide; copper(II) oxide; copper chromite; copper salicylate; copper stearate; hexamminecopper (II) perchlorate; cerium(IV) ammonium nitrate; cerium(IV) oxide; hexamminecobalt(II) perchlorate; cobaltocene; hexamminezinc(II) perchlorate; bismuth salicylate; or bismuth subsalicylate.

17. The formulation of claim 13, wherein the one or more stabilizers are selected from at least one of: N,N'-bis(cyclohexyl)urea; N,N'-diphenylurea; di-tert-butyl resorcinol (DBR); N-ethyl-para-toluenesulfonamide (NETS); diphenylamine (DPA); alkylated DPA (Agerite Stalite); isopropoxy DPA (ISO); dinapthyl phenylenediamine (Agerite White); napthyl phenylamine (Neozone-D); 2-nitrodiphenyl amine (NDPA); 2,4-dinitrophenylamine (DNDPA); N,N'-diphenyl para-phenylenediamine; dinapthyl phenylenediamine; methylaminoanthraquinone; N,N'-diphenylbenzidine; tetraphenylhydrazine; para-nitroaniline; N-methyl-ortho-nitroaniline; N-methyl-para-nitroaniline (NMA); N-ethyl-para-nitroaniline (NENA); N-(2-cyanoethyl)-para-chloroaniline; N-phenacyl-para-chloroaniline; di(tridecyl) thiodipropionate; elemental sulfur; or 2,2'-methylenebis-(4-methyl-6-tert-butylphenol) (AO-2246).

18. The formulation of claim 13, wherein the one or more photoinitiators are selected from at least one of: Type I photoinitiators, or Type II photoinitiators and co-initiators.

19. The formulation of claim 13, wherein the one or more plasticizers are selected from at least one of: both energetic and inert plasticizers and selected from at least one of: dioctyl adipate (DOA); isodecyl pelargonate (IDP); N-butylnitratoethylnitramine (butylNENA); nitroglycerine; butanetriol trinitrate (BTTN); dinitrotoluene (DNT); trimethylolethane trinitrate (TMETN); diethylene glycol dinitrate (DEGDN); triethylene glycol dinitrate (TEGDN); bis (2,2-dinitropropyl) formal (BDNPF); bis(2,2-dinitropropyl) acetal (BDNPA); and 2,2,2-trinitroethyl 2-nitroxyethyl ether (TNEN); TA (Triacetin); DEP (diethylphathalate); and DBP (dibutylphathalate); trimethylol ethane trinitrate; triethylene glycol dinitrate; ethylene glycol dinitrate; 1,2,4-butanetriol trinitrate; nitroglycerine; bis(2,2,-dinitropropyl)acetal; bis (2,2,-dinitropropyl)formal; glycidyl azide; ethylene glycol bis(azidoacetate); diethylene glycol bis(azidoacetate); trimethylol nitromethane tris(azidoacetate); pentaerythritol tetrakis(azidoacetate); 2,4-dinitroethylbenzene; 2,4,6-trinitroethylbenzene; methyl nitratoethylnitramine; ethyl nitratoethylnitramine; propyl nitratoethylnitramine; butyl nitratoethylnitramine; pentyl nitratoethylnitramine; isopropyl nitratoethylnitramine; 1,5-diazido-3-nitrazapentane; dinitroxy ethyl nitramine; dioctyl phthalate; diisononyl phthalate; dioctyl adipate; diisononyl adipate; bis(2-ethylhexyl) phthalate; diisodecyl phthalate; bis(2-ethylhexyl) adipate; bis(2-ethylhexyl) terephthalate; dioctyl terephthalate; and 2-nitrophenyl octyl ether.

20. The formulation of claim 1, wherein the one or more additives are present in the formulation in amounts less than 5%, often less than 2%, or around 1% weight-to-weight.

* * * * *